US008508142B2

(12) United States Patent
Lin et al.

(10) Patent No.: US 8,508,142 B2
(45) Date of Patent: Aug. 13, 2013

(54) PORTABLE LIGHTING DEVICE AND METHOD THEREOF

(75) Inventors: Yung Lin Lin, Palo Alto, CA (US); Sheng-Tai Lee, Taipei (TW)

(73) Assignee: O2Micro Inc., Santa Clara, CA (US)

( * ) Notice: Subject to any disclaimer, the term of this patent is extended or adjusted under 35 U.S.C. 154(b) by 0 days.

(21) Appl. No.: 13/400,121

(22) Filed: Feb. 20, 2012

(65) Prior Publication Data

US 2012/0176066 A1 Jul. 12, 2012

Related U.S. Application Data

(63) Continuation-in-part of application No. 12/493,420, filed on Jun. 29, 2009, now Pat. No. 8,120,263, and a continuation-in-part of application No. 13/289,364, filed on Nov. 4, 2011.

(60) Provisional application No. 61/413,578, filed on Nov. 15, 2010.

(30) Foreign Application Priority Data

Mar. 20, 2009 (CN) ..... 2009 1 0129517
Mar. 20, 2009 (CN) ..... 2009 2 0006674 U

(51) Int. Cl.
*H05B 37/02* (2006.01)
*H05B 39/02* (2006.01)
*H05B 39/04* (2006.01)
*H05B 41/36* (2006.01)

(52) U.S. Cl.
USPC ..... 315/209 R; 315/200 A; 315/308; 362/157

(58) Field of Classification Search
USPC ..... 315/200 A, 209 R, 224, 291, 307
See application file for complete search history.

(56) References Cited

U.S. PATENT DOCUMENTS

| | | | |
|---|---|---|---|
| 5,539,299 | A | 7/1996 | Fernandez et al. |
| 6,380,711 | B2 | 4/2002 | Fischer et al. |
| 6,657,415 | B2 | 12/2003 | Saeki et al. |
| 6,724,376 | B2 | 4/2004 | Sakura et al. |
| 7,375,472 | B2 | 5/2008 | Wong et al. |
| 7,738,852 | B2 | 6/2010 | Lin et al. |
| 7,796,410 | B2 | 9/2010 | Takayanagi et al. |
| 8,324,825 | B2 | 12/2012 | Shao et al. |
| 2004/0233144 | A1 | 11/2004 | Rader et al. |

(Continued)

FOREIGN PATENT DOCUMENTS

| | | | |
|---|---|---|---|
| CN | 100401616 | C | 7/2008 |
| JP | 2006158186 | A | 6/2006 |
| TW | I304678 | B | 12/2008 |

*Primary Examiner* — Jany Richardson

(57) ABSTRACT

A portable lighting device includes a controller, a power source that provides a voltage, and a load that includes a light emitting diode (LED) light source. The controller receives the voltage and regulates a current of the LED light source based on a sensing signal indicating the voltage of the power source. The controller regulates the current of the LED light source to a first current level if the voltage of the power source is greater than a first voltage level, and to a second current level if the voltage of the power source is less than a second voltage level. The second voltage level is less than the first voltage level. The controller regulates the current of the LED light source to vary according to the sensing signal if the voltage of the power source is between the first voltage level and the second voltage level.

20 Claims, 25 Drawing Sheets

(56) References Cited

U.S. PATENT DOCUMENTS

| | | | | |
|---|---|---|---|---|
| 2007/0217188 | A1 | 9/2007 | Klipstein et al. | |
| 2008/0088254 | A1 | 4/2008 | Yang | |
| 2008/0100143 | A1 | 5/2008 | Lipcsei | |
| 2010/0072915 | A1 | 3/2010 | Chu et al. | |
| 2010/0102773 | A1* | 4/2010 | Lipcsei | 320/101 |
| 2010/0201305 | A1 | 8/2010 | Petroianu et al. | |
| 2010/0270862 | A1 | 10/2010 | Miyanaga et al. | |

* cited by examiner

PORTABLE LIGHTING DEVICE AND METHOD THEREOF

RELATED APPLICATION

The present application is a continuation-in-part of U.S. patent application Ser. No. 12/493,420, titled "Portable Lighting Device and Method Thereof," filed on Jun. 29, 2009, which itself claims priority to Chinese Patent Application No. 200910129517.X, titled "Portable Lighting Device and Method Thereof," inventors Sheng-Tai Lee and Yung Lin Lin, filed on Mar. 20, 2009 with the State Intellectual Property Office of the People's Republic of China and to Chinese Utility Model Patent Application No. 200920006674.7, titled "Portable Lighting Device and Method Thereof," inventors Sheng-Tai Lee and Yung Lin Lin, filed on Mar. 20, 2009 with the State Intellectual Property Office of the People's Republic of China, and the present application is also a continuation-in-part of U.S. patent application Ser. No. 13/289,364, titled "Power Systems with Multiple Power Sources," filed on Nov. 4, 2011, which itself claims priority to U.S. Provisional Application No. 61/413,578, titled "Power Systems with Multiple Power Sources," filed on Nov. 15, 2010, all of which are fully incorporated herein by reference.

BACKGROUND

FIG. 1 shows a block diagram of a conventional power system 100 which includes a first power source, e.g., an adapter 102, and a second power source, e.g., a battery 110. The power system 100 further includes a direct-current to direct-current (DC/DC) converter 104, a charger 106, a switch 103, a switch 105, and a load, e.g., a light-emitting diode (LED) 108. The adapter 102 can be coupled to an AC power source (e.g., a 120V commercial power supply) and convert an AC voltage from the AC power source to a DC voltage $V_{AD}$.

In operation, when the switch 103 is turned on and the switch 105 is turned off, the power system 100 operates in a battery charging process. The adapter 102 delivers the DC voltage $V_{AD}$ to charge the battery 110 and can also power the LED 108. The charger 106 provides proper charging power to the battery 110. The DC/DC converter 104 receives the DC voltage $V_{AD}$ and provides the LED 108 with regulated power. When the switch 105 is turned on and the switch 103 is turned off, the battery 110 provides power to the LED 108 via the DC/DC converter 104.

However, there are two power chains in the power system 100. One power chain includes the charger 106, and the other includes the DC/DC converter 104. These two power chains increase the power consumption of the power system 100, thereby reducing the system power efficiency. These two power chains also increase the complexity of the power system 100. In addition, with the use of both the charger 106 and the DC/DC converter 104, the size of the printed circuit board (PCB) may be relatively large, which increase the cost of the power system 100.

SUMMARY

The present invention provides a portable lighting device. The portable lighting device includes a controller, a power source that provides a voltage, and a load that includes a light emitting diode (LED) light source. The controller receives the voltage and regulates a current of the LED light source based on a sensing signal indicating the voltage of the power source. The controller regulates the current of the LED light source to a first current level if the sensing signal indicates that the voltage of the power source is greater than a first voltage level, and regulates the current of the LED light source to a second current level if the sensing signal indicates that the voltage of the power source is less than a second voltage level. The second voltage level is less than the first voltage level. The controller regulates the current of the LED light source to vary according to the sensing signal if the sensing signal indicates that the voltage of the power source is between the first voltage level and the second voltage level.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
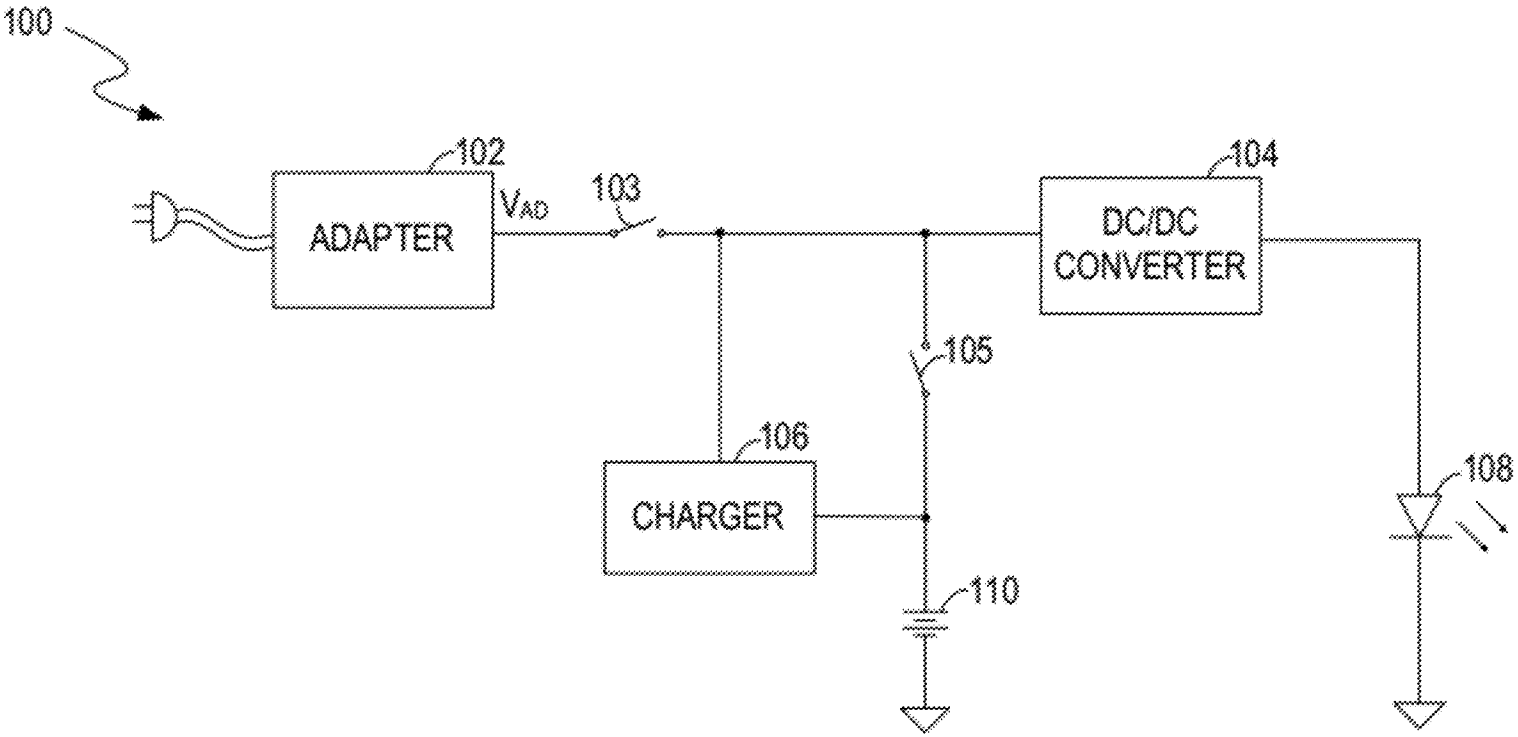
FIG. 1 PRIOR ART
FIG. 1 illustrates a block diagram of a conventional power system.
Figure 2:
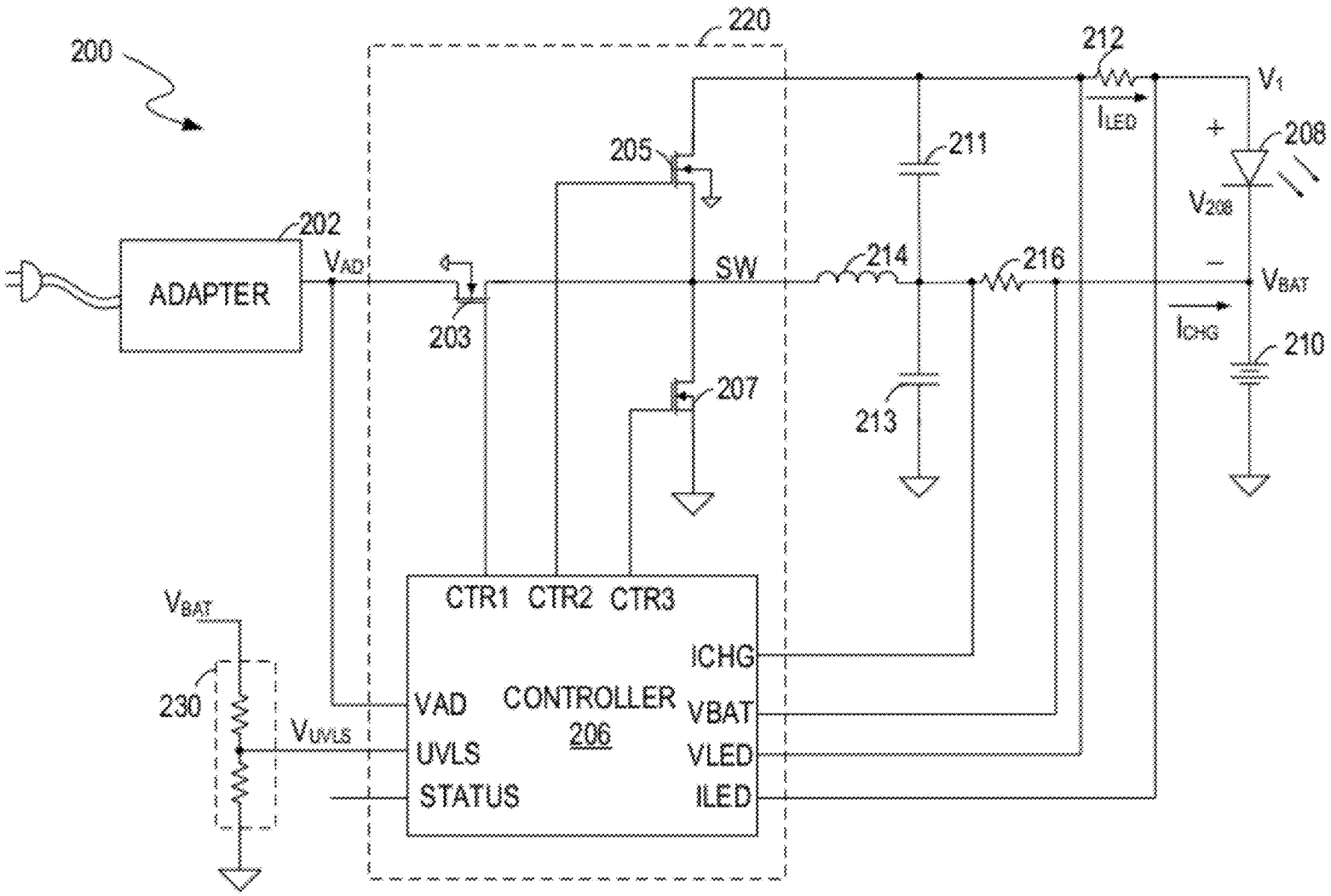
FIG. 2 illustrates a diagram of an example of a power system, in accordance with one embodiment of the present invention.

FIG. 2 illustrates a diagram of an example of a power system 200, in accordance with one embodiment of the present invention. In the example of FIG. 2, the power system 200 includes a first power source, e.g., an adapter 202, a second power source, e.g., a battery 210, switches 203, 205 and 207, a controller 206, and a load, e.g., a light-emitting diode (LED) light source 208. The adapter 202 can receive an AC voltage or a DC voltage and provide an output DC voltage $V_{AD}$. In one embodiment, the power system 200 selectively operates in a charging mode and a load-powering mode. The controller 206 coupled to the adapter 202 and the battery 210 compares the voltage $V_{AD}$ of the adapter 202 with a voltage $V_{BAT}$ of the battery 210. The controller 206 controls the adapter 202 to charge the battery 210 via the switches 203 and 207 in the charging mode when the voltage $V_{AD}$ of the adapter 202 is greater than the voltage $V_{BAT}$ of the battery 210. More specifically, in the charging mode, the controller 206 turns off the switch 205 and alternately turns on the switches 203 and 207 such that the adapter 202 charges the battery 210, e.g., in a constant-current phase or a constant-voltage phase according to the status of the battery 210, e.g., according to the battery voltage. The controller 206 controls the battery 210 to power the LED light source 208 via the switches 205 and 207 in the load-powering mode when the voltage $V_{BAT}$ of the battery 210 is greater than the voltage $V_{AD}$ of the adapter 202. More specifically, in the load-powering mode, the controller 206 turns off the switch 203 and alternately turns on the switches 205 and 207 such that the battery 210 powers the LED light source 208. The controller 206 can be integrated together with the switches 203, 205 and 207 in an integrated circuit (IC) chip 220 (referred to as the control circuit 220). Although the power system 200 is described in relation to an adapter, a battery and an LED light source for illustrative purposes, the invention is not so limited. The adapter 202 and the battery 210 can be replaced by other types of power sources and the LED light source 208 can be replaced by multiple LEDs, or other types of light sources or loads.

In one embodiment, the controller 206 includes an output terminal CTR1 to control the on/off status of the switch 203, an output terminal CTR2 to control the on/off status of the switch 205, and an output terminal CTR3 to control the on/off status of the switch 207. By way of example, the switch 203, 205 or 207, e.g., an N-channel MOSFET, is on when a control signal from the corresponding output terminal CTR1, CTR2 or CTR3 is logic high, and is off when the control signal is logic low. The controller 206 can further include an input terminal VAD to detect the voltage $V_{AD}$ from the adapter 202, an input terminal VBAT to detect the battery voltage $V_{BAT}$, an input terminal ICHG cooperating with the terminal VBAT for sensing a charging current $I_{CHG}$ from the adapter 202 to the battery 210 by monitoring a voltage $V_{216}$ across a sense resistor 216, a terminal VLED for receiving a signal indicative of a voltage $V_{LED}$ at the anode of the LED light source 208, a terminal ILED cooperating with the terminal VLED for sensing a current $I_{LED}$ flowing through the LED light source 208 by monitoring a voltage $V_{212}$ across a sense resistor 212, and a terminal UVLS coupled to a resistor divider 230 for receiving a voltage $V_{UVLS}$ indicative of the battery voltage $V_{BAT}$, e.g., the voltage $V_{UVLS}$ is proportional to the battery voltage $V_{BAT}$. In one embodiment, the controller 206 adjusts an adjustable reference voltage $V_{ADJ}$ based on the voltage $V_{UVLS}$. The controller 206 can adjust the current $I_{LED}$ flowing through the LED light source 208 according to the adjustable reference voltage $V_{ADJ}$. Moreover, the controller 206 can include a terminal STATUS for indicating a status of the battery 210, e.g., whether the battery 210 is fully charged or not.

Figure 3A:
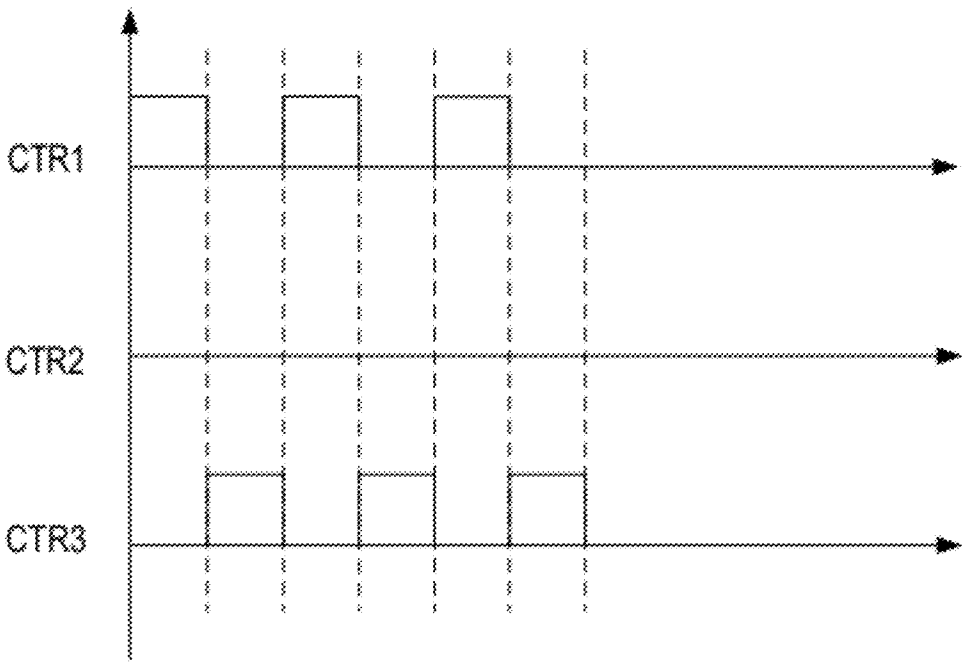
FIG. 3A illustrates a timing diagram of examples of control signals of the power system in FIG. 2 in a charging mode.

When the adapter 202 is coupled to a power source, e.g., a 120V commercial power supply, the adapter 202 converts a voltage from the power source to a DC voltage $V_{AD}$. The controller 206 compares the DC voltage $V_{AD}$ with the battery voltage $V_{BAT}$. In one embodiment, when the DC voltage $V_{AD}$ is greater than the battery voltage $V_{BAT}$ and the battery 210 is not fully charged, e.g., the battery voltage $V_{BAT}$ is less than a threshold, the power system 200 operates in the charging mode. FIG. 3A shows a timing diagram of examples of control signals from the output terminals CTR1, CTR2 and CTR3 in the charging mode. In the example of FIG. 3A, the control signals from the output terminals CTR1 and CTR3 are non-overlapping pulse signals, e.g., pulse-width modulation signals, to turn the switches 203 and 207 on alternately. The control signal from the output terminal CTR2 remains at logic low to turn off the switch 205.

Referring back to FIG. 2, in the charging mode, switches 203 and 207, an inductor 214 and a capacitor 213 operate as a buck converter to charge the battery 210, in one embodiment. More specifically, when the switch 203 is on and the switch 207 is off, the adapter 202 charges the battery 210 via the inductor 214. Meanwhile, the inductor 214 stores energy. When the switch 203 is off and the switch 207 is on, the inductor 214 is discharged to provide charging power to the battery 210.

In one embodiment, the controller 206 monitors the battery voltage $V_{BAT}$ and a charging current of the battery 210 to control the charging process of the battery 210. More specifically, the controller 206 compares the battery voltage $V_{BAT}$ with a predetermined threshold $V_{TH}$ and controls a duty cycle of the switch 203 to adjust charging power from the adapter 202 to the battery 210 in the charging mode. When the battery voltage $V_{BAT}$ is less than the predetermined threshold $V_{TH}$, the controller 206 controls the switch 203 and the switch 207 to charge the battery 210 in the constant-current phase, in which a substantially constant current is used to charge the battery 210. For example, when the voltage $V_{216}$ across the sense resistor 216 is greater than a reference voltage $V_{BATREF}$, e.g., the charging current $I_{CHG}$ is greater than a predetermined charging current $I_{BATREF}$, the controller 206 decreases the charging current $I_{CHG}$ by decreasing the duty cycle of the switch 203; when the voltage $V_{216}$ across the sense resistor 216 is less than the reference voltage $V_{BATREF}$, e.g., the charging current $I_{CHG}$ is less than the predetermined charging current $I_{BATREF}$, the controller 206 increases the charging current $I_{CHG}$ by increasing the duty cycle of the switch 203. If, however, the battery voltage $V_{BAT}$ increases to the predetermined threshold $V_{TH}$, the controller 206 controls the switch 203 and the switch 207 to charge the battery 210 in the constant-voltage phase, in which the charging voltage is maintained at the predetermined threshold $V_{TH}$, in one embodiment.

The controller 206 can also monitor parameters, e.g., a voltage, temperature and a current, of the battery 210 to determine if an abnormal or undesired condition occurs. In one embodiment, the controller 206 compares the sensed battery voltage $V_{BAT}$ with an over-voltage threshold $V_{OV}$ to determine if an over-voltage condition occurs. If the sensed battery voltage $V_{BAT}$ is greater than the over-voltage threshold $V_{OV}$, the controller 206 turns off the switch 203 and the switch 207 to terminate charging of the battery 210, in one embodiment.

The controller 206 can also compare a signal, e.g., the voltage $V_{216}$ across the resistor 216, indicative of the charging current $I_{CHG}$, with a predetermined threshold $V_{OC}$ representative of an over-charging current $I_{OC}$ to determine if an over-current condition occurs. If the voltage $V_{216}$ across the resistor 216 is greater than the predetermined threshold representative the over-charging current $I_{OC}$, the controller 206 turns off the switches 203 and 207 to terminate charging of the battery 210, in one embodiment.

The controller 206 can also compare a signal from a thermistor (not shown in FIG. 2) with an over-temperature threshold $V_{OT}$ to determine if an over-temperature condition occurs. If the sensed signal is greater than the predetermined threshold $V_{OT}$, the controller 206 turns off the switches 203 and 207 to terminate charging of the battery 210, in one embodiment.

In the charging mode, the controller 206 can detect the battery resistance $R_{BAT}$ according to the battery voltage $V_{BAT}$ and the charging current $I_{CHG}$, as shown in equation (1):

$$R_{BAT}=V_{BAT}/I_{CHG}. \quad (1)$$

The controller 206 can thus determine the battery type based on the battery resistance $R_{BAT}$. If the battery type determined by the controller 206 is a non-rechargeable battery, e.g., alkaline battery, the controller 206 terminates charging of the batter 210 to protect the battery 210 and the power system 200.

Figure 3B:
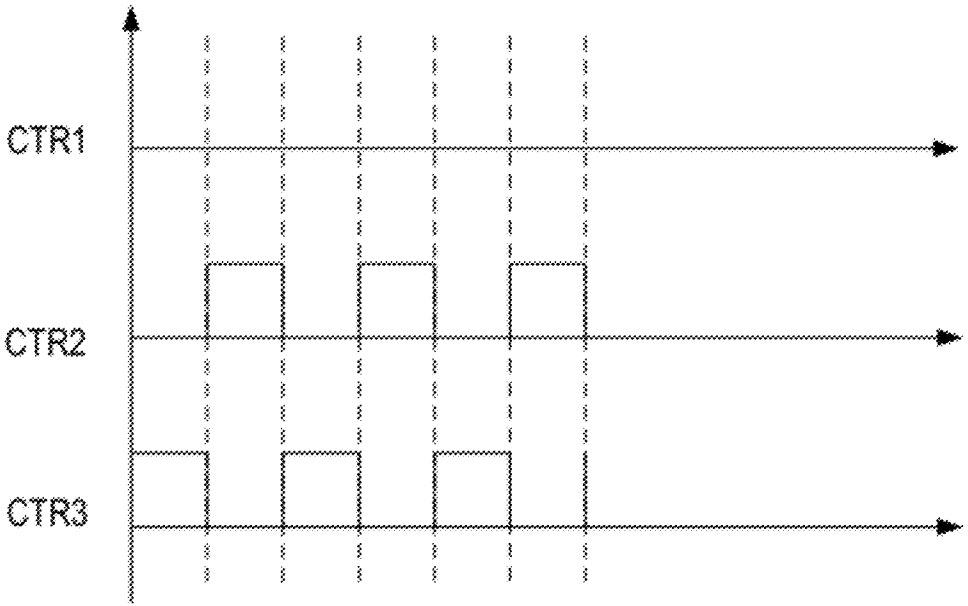
FIG. 3B illustrates a timing diagram of examples of control signals of the power system in FIG. 2 in a load-powering mode.

In addition, the power system 200 can operate in the load-powering mode. FIG. 3B shows a timing diagram of examples of the control signals from the output terminals CTR1, CTR2 and CTR3 in the load-powering mode. As shown in FIG. 3B, the control signals from the output terminals CTR2 and CTR3 are non-overlapping pulse signals, e.g., pulse-width modulation signals, to turn on the switches 205 and 207 alternately. The control signal from the output terminal CTR1 remains at logic low to turn off the switch 203.

In the load-powering mode, the switches 205 and 207, the inductor 214, and capacitors 211 and 213 can operate as a buck-boost converter to power the LED light source 208. More specifically, when the switch 207 is on and the switch 205 is off, the battery 210 charges the inductor 214. When the switch 207 is off and the switch 205 is on, the battery 210 together with the inductor 214 provides power to the LED light source 208. In one such embodiment, by turning on the switches 205 and 207 alternately with an adjustable duty cycle, a voltage $V_1$ that is greater than the battery voltage $V_{BAT}$ is generated at a terminal of the LED light source 208. Thus, the voltage $V_{208}$ across LED light source 208 is equal to a voltage $V_1$ minus the battery voltage $V_{BAT}$. In one embodiment, by the operation of the buck-boost converter, the voltage $V_{208}$ can be adjusted to be greater than the battery voltage $V_{BAT}$ or less than the battery voltage $V_{BAT}$. As such, the power system 200 can power various types and numbers of load and thus the flexibility of the power system 200 is enhanced.

Figure 2A:
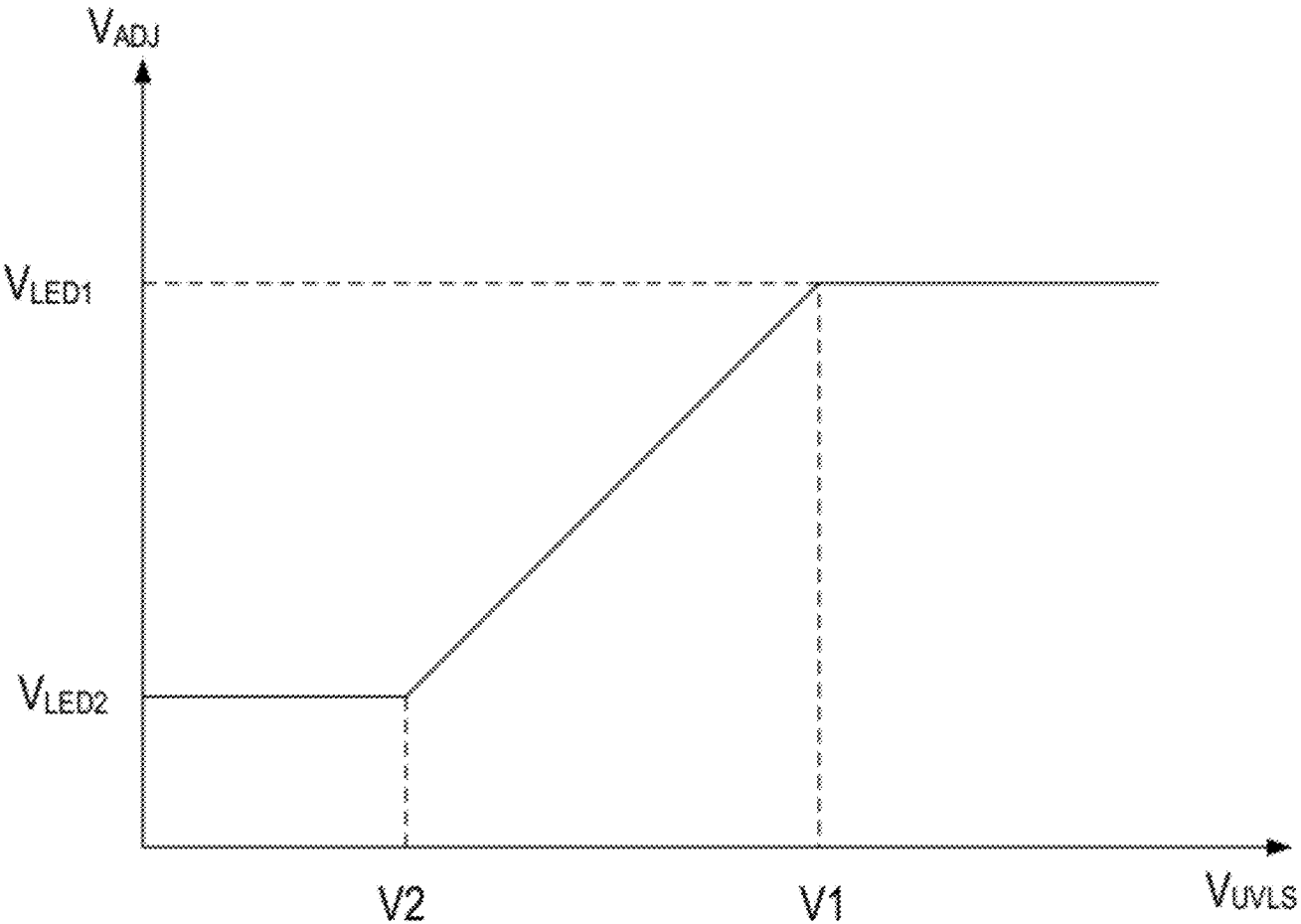
FIG. 2A illustrates an example of a diagram showing a relationship between an adjustable reference voltage VADJ and a voltage VUVLS of the power system in FIG. 2, in accordance with one embodiment of the present invention.

In one embodiment, the controller 206 monitors the current $I_{LED}$ flowing though the LED light source 208 via the terminals VLED and ILED, and controls a duty cycle of the switch 207 to adjust the current $I_{LED}$ according to the adjustable reference voltage $V_{ADJ}$. FIG. 2A shows an example of a diagram showing a relationship between the adjustable reference voltage $V_{ADJ}$ and the voltage $V_{UVLS}$ of the power system 200 in FIG. 2, in accordance with one embodiment of the present invention. When the voltage $V_{UVLS}$ is greater than a first threshold V1, the controller 206 adjusts the adjustable reference voltage $V_{ADJ}$ to a first constant voltage level $V_{LED1}$. Thus, the controller 206 adjusts the current $I_{LED}$ through the LED light source 208 to a first predetermined current $I_{LEDREF1}$. When the voltage $V_{UVLS}$ is less than a second threshold V2, the controller 206 adjusts the adjustable reference voltage $V_{ADJ}$ to a second constant voltage level $V_{LED2}$. Thus, the controller 206 adjusts the current $I_{LED}$ through the LED light source 208 to a second predetermined current $I_{LEDREF2}$. When the voltage $V_{UVLS}$ is less than the first threshold V1 but greater than the second threshold V2, the controller 206 adjusts the adjustable reference voltage $V_{ADJ}$ to vary according to the voltage $U_{UVLS}$. In one embodiment, the adjustable reference voltage $V_{ADJ}$ varies linearly with the voltage $U_{UVLS}$. Because the voltage $U_{UVLS}$ is proportional to the battery voltage $V_{BAT}$, the adjustable reference voltage $V_{ADJ}$ varies linearly with the battery voltage $V_{BAT}$. As such, the controller 206 regulates the current $I_{LED}$ to vary linearly according to the battery voltage $V_{BAT}$. Advantageously, the battery running time can be extended, thereby extending the operation time of LED light source.

Returning back to FIG. 2, the controller 206 compares a signal indicative of the current $I_{LED}$, e.g., the voltage $V_{212}$ across the resistor 212, with the adjustable reference voltage $V_{ADJ}$, and controls the switches 205 and 207 according to the comparison. If the voltage $V_{212}$ is greater than the adjustable reference voltage $V_{ADJ}$, e.g., the current $I_{LED}$ increases, the controller 206 decreases the duty cycle of the switch 207, thereby decreasing the current $I_{LED}$. If the voltage $V_{212}$ is less than the adjustable reference voltage $V_{ADJ}$, e.g., the current $I_{LED}$ decreases, the controller 206 increases the duty cycle of the switch 207 to increase the current $I_{LED}$. As a result, the current $I_{LED}$ flowing through the LED light source 208 is adjusted according to the adjustable reference voltage $V_{ADJ}$ as described in relation to FIG. 2A.

Advantageously, because the switches 203, 205 and 207, the inductor 214, and the capacitors 211 and 213 can operate as a buck converter and a buck-boost converter in the charging mode and the load-powering mode, the flexibility of the power system 200 is improved. The power system 200 can support various types of loads and power sources. Moreover, the two power chains, e.g., the charger 106 and the converter 104, in the conventional power system 100 are replaced by one power chain, e.g., the converter that includes the control circuit 220. Accordingly, the power consumption of the power system 200 decreases. The complexity of the power system 200 decreases, which enhances the reliability of the power system 200. In addition, the size of the PCB and the cost of the power system 200 are reduced.

Figure 4:
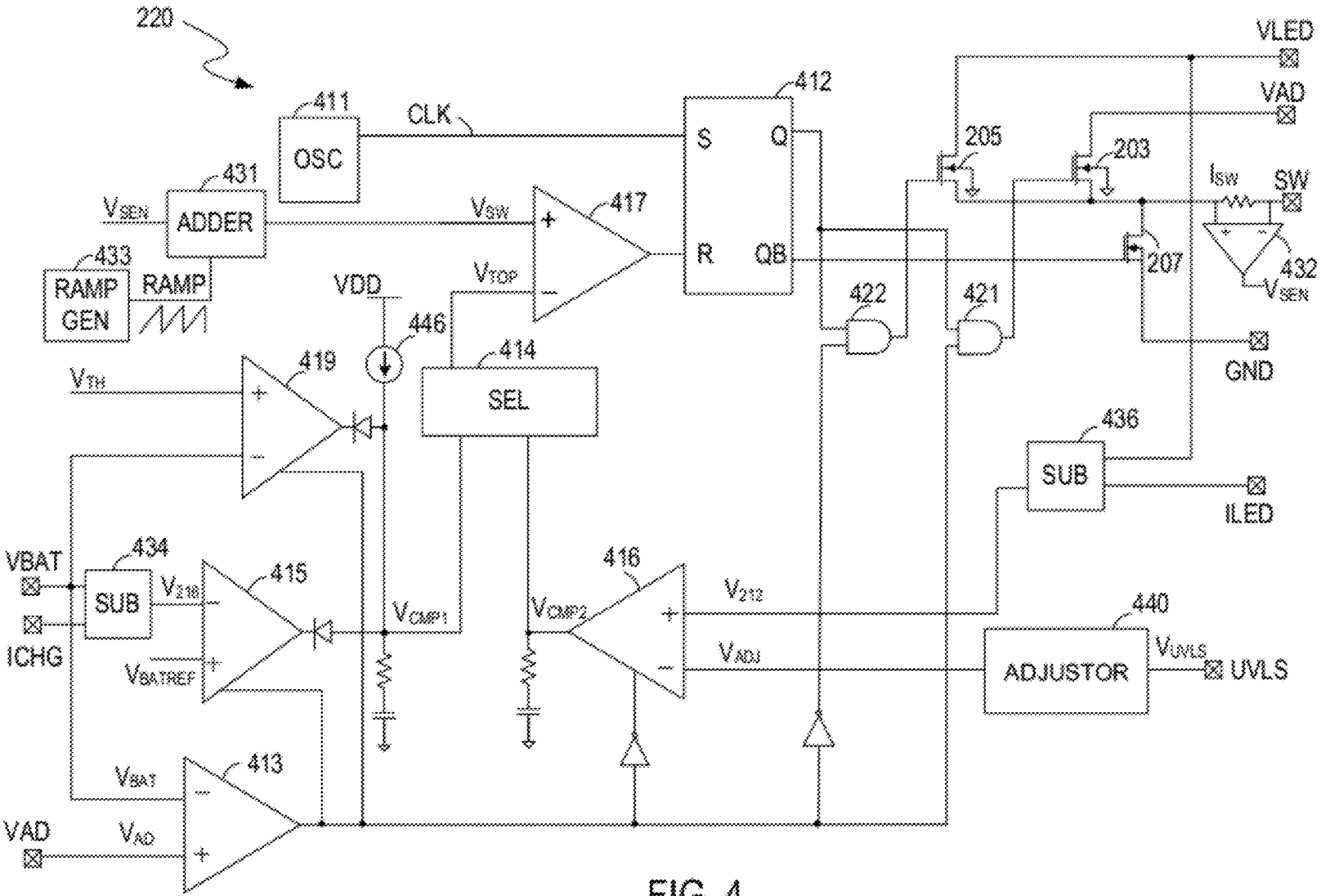
FIG. 4 illustrates a diagram of an example of the control circuit 220 in the power system in FIG. 2, in accordance with one embodiment of the present invention.

FIG. 4 illustrates a diagram of an example of a control circuit 220 in the power system 200 in FIG. 2 according to one embodiment of the present invention. FIG. 4 is described in combination with FIG. 2. In the example of FIG. 4, the control circuit 220 includes an oscillator 411, comparators 413 and 417, error amplifiers 415, 416 and 419, a selector 414, a flip-flop 412, AND gates 421 and 422, switches 203, 205 and 207, an adder 431, an amplifier 432, a ramp signal generator 433, subtractors 434 and 436, and a voltage adjustor 440.

In one embodiment, the comparator 413 compares the battery voltage $V_{BAT}$ at the terminal VBAT with the DC voltage $V_{AD}$ at the terminal VAD and generates a comparison signal to enable or disable the error amplifiers 415, 416 and 419. A negative terminal of a current source 446, an output of the error amplifier 415 and an output of the error amplifier 419 are coupled to a common node, in one embodiment. In one such embodiment, the error amplifier 415 and the error amplifier 419 are OR-tied together. In one embodiment, the comparator 413 enables the error amplifiers 415 and 419 in the charging mode when the DC voltage $V_{AD}$ is greater than the battery voltage $V_{BAT}$, and enables the error amplifier 416 in the load-powering mode when the DC voltage $V_{AD}$ is less than the battery voltage $V_{BAT}$. The error amplifier 415, when enabled, compares a signal indicative of the charging current to the battery 210, e.g., a signal from the subtractor 434 representative of the voltage $V_{216}$ across the resistor 216, with a reference voltage signal $V_{BATREF}$, and controls an output voltage $V_{CMP1}$ at the common node according to the comparison. The error amplifier 419, when enabled, compares the battery voltage $V_{BAT}$ with the predetermined threshold $V_{TH}$, and controls the output voltage $V_{CMP1}$ at the common node according to the comparison. The error amplifier 416, when enabled, compares a signal indicative of the current through the LED light source 208, e.g., a signal from the subtractor 436 representative of the voltage $V_{212}$ across the resistor 212, with an adjustable reference voltage signal $V_{ADJ}$ and controls an output voltage $V_{CMP2}$ according to the comparison. The selector 414, coupled to the error amplifiers 415, 419 and 416, selects an output voltage from the output voltages $V_{CMP1}$ and $V_{CMP2}$ and outputs the selected output voltage as an output voltage $V_{TOP}$, in one embodiment. More specifically, when the error amplifiers 415 and 419 are enabled by the comparator 413, e.g., when the DC voltage $V_{AD}$ is greater than the battery voltage $V_{BAT}$, the selector 414 selects the output voltage $V_{CMP1}$. When the error amplifier 416 is enabled by the comparator 413, e.g., when the DC voltage $V_{AD}$ is less than the battery voltage $V_{BAT}$, the selector 414 selects the output voltage $V_{CMP2}$. The output voltage $V_{TOP}$ is received by the comparator 417.

An input of the adder 431 is coupled to the amplifier 432 to receive a signal $V_{SEN}$ representative of a current $I_{SW}$ flowing through the inductor 214, and another input of the adder 431 is coupled to the ramp generator 433 to receive a ramp signal RAMP, in the example of FIG. 4. As a result, the output $V_{SW}$ of the adder 431 is the summation of the signal $V_{SEN}$ and the signal RAMP. The comparator 417 compares the signal $V_{SW}$ output by the adder 431 with the output voltage $V_{TOP}$ of the selector 414, and provides an output to the terminal R of the flip-flop 412 to control the switches 203, 205 and 207. The terminal S of the flip-flop 412 is coupled to the oscillator 411 to receive a clock signal CLK. For example, the clock signal CLK has a frequency of 1 MHz. The inverting output terminal QB of the flip-flop 412 controls the switch 207. In addition, the non-inverting output terminal Q of the flip-flop 412 cooperates with the comparator 417 to control the switches 203 and 205 via the AND gates 421 and 422.

During operation, when the DC voltage $V_{AD}$ is greater than the battery voltage $V_{BAT}$, the output of the comparator 413 is in a first state, e.g., logic high, thereby enabling the power system 200 to operate in the charging mode in which the error amplifiers 415 and 419 are enabled while the error amplifier 416 is disabled. In the charging mode, the AND gate 422 controls the switch 205 to be turned off. The flip-flop 412, together with the AND gate 421, alternately turns on the switches 203 and 207. The flip-flop 412 further controls the duty cycles of the switches 203 and 207 according to a comparison of the signal $V_{SW}$ with the output voltage $V_{TOP}$ from the selector 414 to control the charging power to the battery 210.

Figure 5:
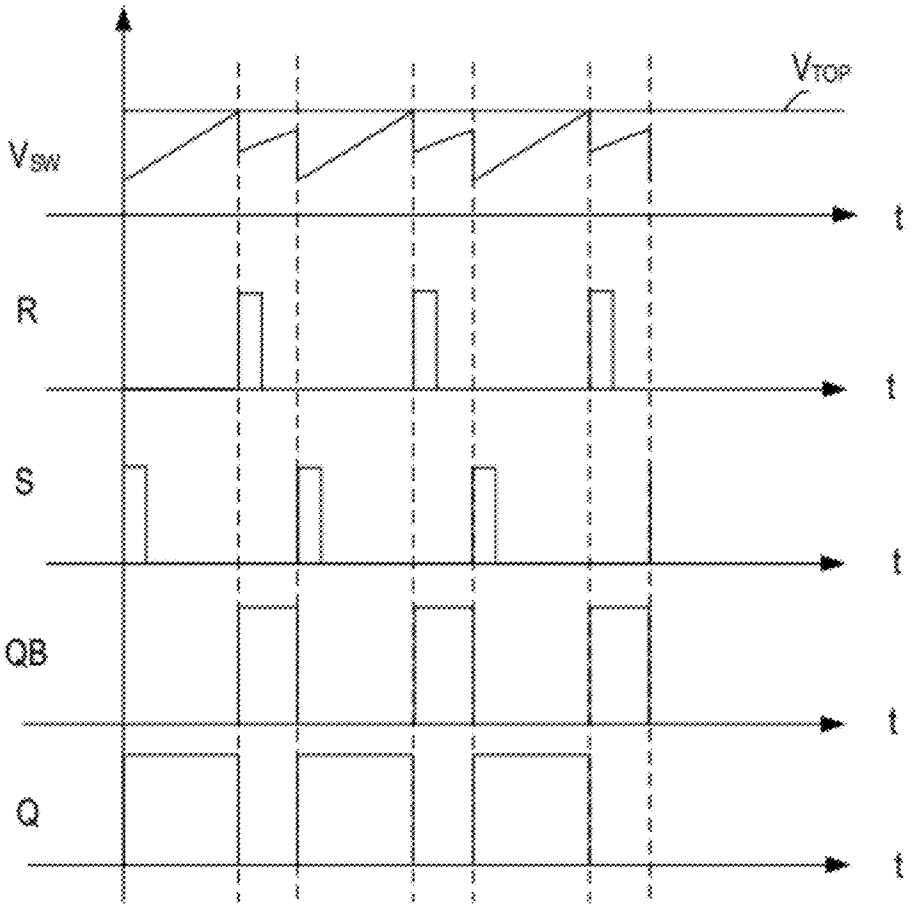
FIG. 5 illustrates a timing diagram of examples of signals associated with a flip-flop in the control circuit 220 in FIG. 4, in accordance with one embodiment of the present invention.

More specifically, in the charging mode, when the battery voltage $V_{BAT}$ is less than the predetermined threshold $V_{TH}$, the control circuit 220 controls the switches 203 and 207 to charge the battery 210 in a constant-current phase, in one embodiment. The error amplifier 415 compares a signal indicative of the charging current to the battery 210, e.g., voltage $V_{216}$ across the resistor 216, with the reference voltage signal $V_{BATREF}$, and controls the output voltage $V_{CMP1}$. The selector 414 selects the output voltage $V_{CMP1}$ as the output voltage $V_{TOP}$. As such, the flip-flop 412 controls the duty cycles of the switches 203 and 207 according to a comparison of the selected output voltage $V_{TOP}$ with the signal $V_{SW}$. FIG. 5 illustrates a timing diagram of examples of signals associated with the flip-flop 412. When the voltage $V_{216}$ is less than the reference voltage $V_{BATREF}$, e.g., the charging current $I_{CHG}$ is less than a predetermined charging current $I_{BATREF}$, the output voltage $V_{CMP1}$ increases. Thus, the output voltage $V_{TOP}$ increases. As a result, the duty cycle of the switch 203 increases, and the charging current $I_{CHG}$ of the battery 210 increases accordingly. When the voltage $V_{216}$ is greater than the reference voltage $V_{BATREF}$, e.g., the charging current $I_{CHG}$ is greater than the predetermined charging current $I_{BATREF}$, the output voltage $V_{CMP1}$ decreases. Thus, the output voltage $V_{TOP}$ decreases. As a result, the duty cycle of the switch 203 decreases, and the charging current $I_{CHG}$ of the battery 210 decreases accordingly. Therefore, the charging current $I_{CHG}$ is adjusted to the predetermined charging current $I_{BATREF}$ in the constant-current phase.

When the battery voltage $V_{BAT}$ reaches the predetermined threshold $V_{TH}$, the control circuit 220 can control the switches 203 and 207 to charge the battery 210 in a constant-voltage phase. In the constant-voltage phase, the error amplifier 419 compares the battery voltage $V_{BAT}$ with the predetermined threshold $V_{TH}$, and controls the output voltage $V_{CMP1}$. For example, when the battery voltage $V_{BAT}$ is greater than the predetermined threshold $V_{TH}$, the output voltage $V_{CMP1}$ decreases. Thus, the output voltage $V_{TOP}$ decreases accordingly. As a result, the duty cycle of the switch 203 decreases, and the charging voltage of the battery 210 decreases accordingly. Therefore, the charging voltage is adjusted to the predetermined threshold $V_{TH}$ in the constant-voltage phase.

When the DC voltage $V_{AD}$ is less than the battery voltage $V_{BAT}$, the output of the comparator 413 is in a second state, e.g., logic low, thereby enabling the power system 200 to operate in the load-powering mode in which the error amplifiers 415 and 419 are disabled while the error amplifier 416 is enabled. In the load-powering mode, the switch 203 is turned off by the AND gate 421. The flip-flop 412, together with the AND gate 422, alternately turns on the switches 205 and 207. The flip-flop 412 further controls the duty cycles of the switches 205 and 207 according to a comparison of the signal $V_{SW}$ with the output voltage $V_{TOP}$ from the selector 414 to control the current $I_{LED}$ through the LED light source 208.

More specifically, in the load-powering mode, the error amplifier 416 compares a signal indicative of the current through the LED light source 208, e.g., the voltage $V_{212}$ across the resistor 212, with the adjustable reference voltage signal $V_{ADJ}$ adjusted by the voltage adjustor 440 based on the voltage $V_{UVLS}$. In one embodiment, the voltage $V_{UVLS}$ is indicative of the battery voltage $V_{BAT}$, e.g., proportional to the battery voltage $V_{BAT}$. When the voltage $V_{UVLS}$ is greater than a first threshold V1, the adjustor 440 adjusts the adjustable reference voltage $V_{ADJ}$ to a first constant voltage level $V_{LED1}$. When the voltage $V_{UVLS}$ is less than a second threshold V2, the adjustor 440 adjusts the adjustable reference voltage $V_{ADJ}$ to a second constant voltage level $V_{LED2}$. When the voltage $V_{UVLS}$ is less than the first threshold V1 but greater than the second threshold V2, the adjustor 440 adjusts the adjustable reference voltage $V_{ADJ}$ to vary linearly according to the voltage $V_{UVLS}$. Because the voltage $V_{UVLS}$ is proportional to the battery voltage $V_{BAT}$, the adjustable reference voltage $V_{ADJ}$ varies linearly according to the battery voltage $V_{BAT}$.

The error amplifier 416 controls the output voltage $V_{CMP2}$ according to the comparison of voltage $V_{212}$ across the resistor 212 with the adjustable reference voltage signal $V_{ADJ}$. The selector 414 selects the output voltage $V_{CMP2}$ as the output voltage $V_{TOP}$. As such, the flip-flop 412 controls the duty cycles of the switches 205 and 207 according to a comparison of the selected output voltage $V_{TOP}$ with the signal $V_{SW}$. FIG. 5 illustrates a timing diagram of examples of signals associated with the flip-flop 412. When the voltage $V_{212}$ is less than the adjustable reference voltage $V_{ADJ}$, e.g., the current $I_{LED}$ through the LED light source 208 decreases, the output voltage $V_{CMP2}$ decreases and the output voltage $V_{TOP}$ decreases accordingly. As a result, the duty cycle of the switch 207 increases, and the current $I_{LED}$ increases accordingly. When the voltage $V_{212}$ is greater than the adjustable reference voltage $V_{ADJ}$, e.g., the current $I_{LED}$ increases, the output voltage CMP2 increases and the output voltage $V_{TOP}$ increases accordingly. As a result, the duty cycle of the switch 207 decreases, and the current $I_{LED}$ decreases accordingly. Therefore, the current $I_{LED}$ through the LED light source 208 is adjusted according to the adjustable reference voltage $V_{ADJ}$. Therefore, the current $I_{LED}$ is adjusted to a first predetermined current $I_{LEDREF1}$ when the voltage $V_{UVLS}$ is greater than a first threshold V1 and a second predetermined current $I_{LEDREF2}$ when the voltage $V_{UVLS}$ is less than the second threshold V2. The current $I_{LED}$ can also be adjusted to vary linearly according to the battery voltage $V_{BAT}$ when the voltage $V_{UVLS}$ is greater than the second threshold V2 but less than the first threshold V1.

The control circuit 220 can further protect the power system 200 by terminating charging of the battery when an abnormal or undesired condition occurs, e.g., an over-current condition, an over-voltage condition, and an over-temperature condition. In one embodiment, the control circuit 220 can include a comparator (not shown in FIG. 4) to compare the battery voltage $V_{BAT}$ with an over-voltage threshold $V_{OV}$ to determine if an over-voltage condition occurs. The control circuit 220 can include a comparator (not shown in FIG. 4) to compare the voltage $V_{216}$ across the resistor 216 with a predetermined threshold representative of an over-charging current $I_{OC}$ to determine if an over-current condition occurs. The control circuit 220 can further include a comparator (not shown in FIG. 4) to compare a signal from a thermistor (not shown in FIG. 4) with an over-temperature threshold $V_{OT}$ to determine if an over-temperature condition occurs. If any of the abnormal conditions occurs, the control circuit 220 turns off the switches 203 and 207 to terminate charging of the battery 210 to protect the power system 200.

The control circuit 220 can further detect the type of the battery 210 and terminate charging the battery 210 if the battery is a non-rechargeable battery, e.g., alkaline battery. As such, the control circuit 220 protects the battery 210 and the power system 200.

Figure 6:
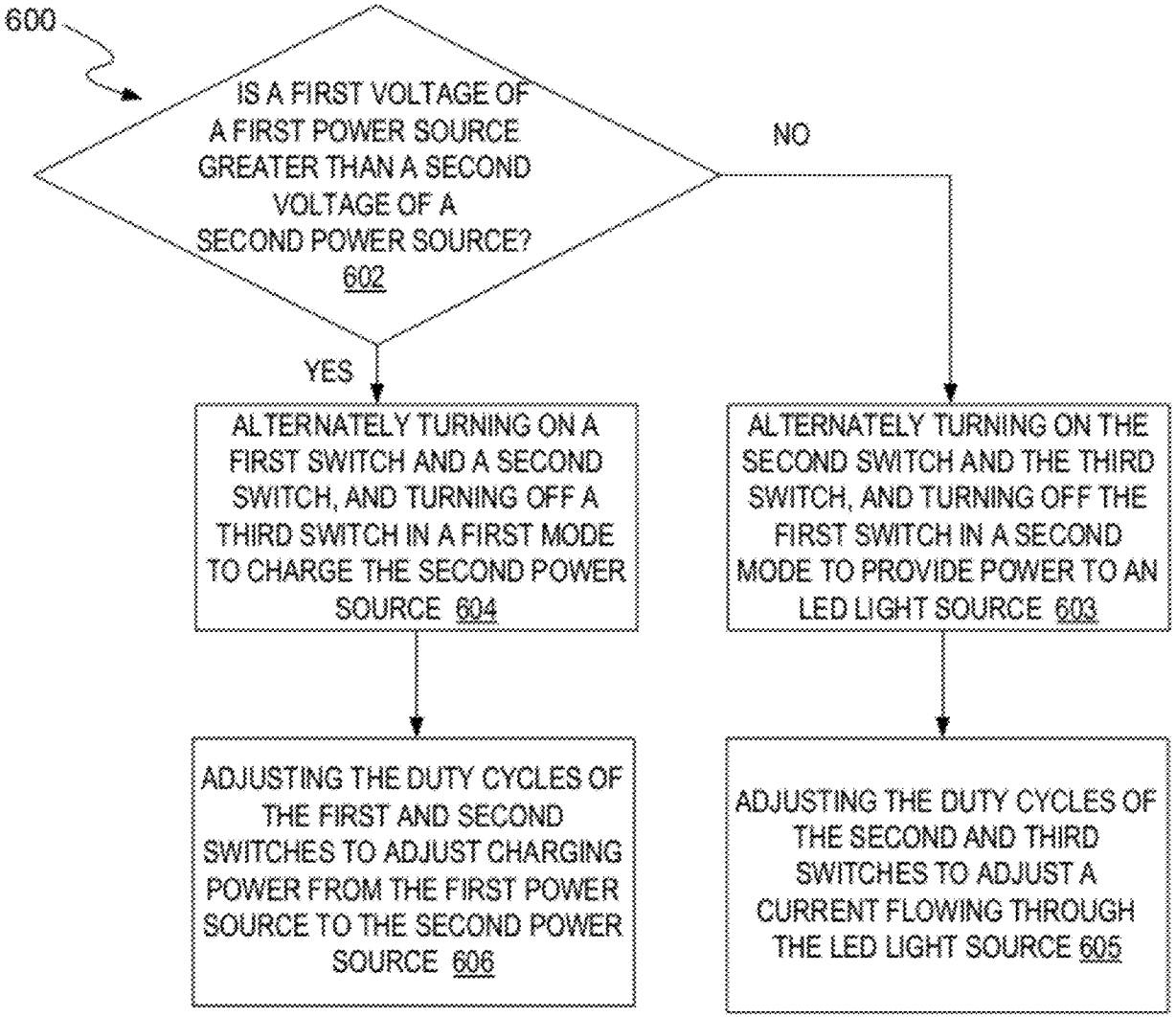
FIG. 6 illustrates a flowchart of examples of operations performed by a power system, in accordance with one embodiment of the present invention.

FIG. 6 illustrates a flowchart of operations 600 performed by a power system, in accordance with one embodiment of the present invention. FIG. 6 is described in combination with FIG. 2 and FIG. 4.

In block 602, a power system, e.g., the power system 200, compares a first voltage of a first power source with a second voltage of a second power source, e.g., a battery. When the first voltage of the first power source is greater than the second voltage of the second power source, the power system 200 can operate in a first mode, e.g., a charging mode. When the first voltage of the first power source is less than the second voltage of the second power source, the power system 200 can operate in a second mode, e.g., a load-powering mode.

If the power system 200 operates in the charging mode, the flowchart goes to block 604. In block 604, the power system 200 alternately turns on a first switch 203 and a second switch 207 to charge the second power source, e.g., a battery 210, and turns off a third switch 205. In block 606, the power system 200 adjusts the duty cycles of the first switch 203 and the second switch 207 to adjust charging power from the first power source to the second power source.

More specifically, when the voltage of the second power source, e.g., the battery voltage $V_{BAT}$, is less than a predetermined threshold $V_{TH}$, the power system 200 charges the second power source in a constant-current phase. In the constant-current phase, the power system 200 compares the charging current $I_{CHG}$ with a predetermined charging current $I_{BATREF}$. When the charging current $I_{CHG}$ is greater than the predetermined charging current $I_{BATREF}$, the power system 200 decreases the duty cycle of the first switch 203 to decrease the charging current $I_{CHG}$. When the charging current $I_{CHG}$ is less than the predetermined charging current $I_{BATREF}$, the power system 200 increases the duty cycle of the first switch 203 to increase the charging current $I_{CHG}$. Therefore, the charging current $I_{CHG}$ is adjusted to the predetermined charging current $I_{BATREF}$.

When the voltage of the second power source, e.g., the battery voltage $V_{BAT}$, reaches the predetermined threshold $V_{TH}$, the power system 200 charges the second power source in a constant-voltage phase. In the constant-voltage phase, the power system 200 compares the battery voltage $V_{BAT}$ with the predetermined threshold $V_{TH}$, and controls the duty cycles of the switches 203 and 207 such that the charging voltage is adjusted to the predetermined threshold $V_{TH}$. Therefore, the second power source is charged in the constant-voltage phase.

If the power system 200 operates in the load-powering mode, the flowchart goes to block 603. In block 603, the power system 200 turns off a first switch 203 and alternately turns on the second switch 207 and the third switch 205 to provide power to a load, e.g., an LED light source 208. In block 605, the power system 200 adjusts the duty cycles of the second and third switches 207 and 205 according to the comparison of the current $I_{LED}$ flowing through the LED light source 208 with an adjustable reference current $I_{ADJ}$. In one embodiment, the adjustable reference current $I_{ADP}$ is adjusted based a voltage $V_{UVLS}$ proportional to the battery voltage $V_{BAT}$. The adjustable reference current $I_{ADJ}$ is adjusted to a first predetermined current $I_{LEDREF1}$ when the voltage $V_{UVLS}$ is greater than a first threshold V1. The adjustable reference current $I_{ADJ}$ is adjusted to a second predetermined current $I_{LEDREF2}$ when the voltage $V_{UVLS}$ is less than a second threshold V2. The adjustable reference current $I_{ADP}$ is adjusted to vary linearly with the voltage $V_{UVLS}$ and the battery voltage $V_{BAT}$ when the voltage $V_{UVLS}$ is less than the first threshold V1 but greater than the second threshold V2.

When the current $I_{LED}$ is greater than the adjustable reference current $I_{ADJ}$, the power system 200 decreases the duty cycle of the second switch 207 to decrease the current $I_{LED}$ flowing through the LED light source 208. When the current $I_{LED}$ is less than the adjustable reference current $I_{ADP}$, the power system 200 increases the duty cycle of the second switch 207 to increase the current $I_{LED}$. Therefore, the current $I_{LED}$ is adjusted according to the adjustable reference current $I_{ADJ}$. Therefore, the current $I_{LED}$ is adjusted to the first predetermined current $I_{LEDREF1}$ when the voltage $V_{UVLS}$ is greater than the first threshold V1 and is adjusted to the second predetermined current $I_{LEDREF2}$ when the voltage $V_{UVLS}$ is less than the second threshold V2. The current $I_{LED}$ can also be adjusted to vary linearly with the battery voltage $V_{BAT}$ when the voltage $V_{UVLS}$ is greater than the second threshold V2 but less than the first threshold V1.

Conventionally, portable lighting devices such as flash lights use incandescent lamps as light sources. In recent years, light emitting diodes (LEDs) has become popular in LCD backlight, home appliance, and street light applications. The adoption of the LEDs for flash lights has been increased due to LEDs' better light efficiency and longer life over incandescent lamps.

Flash lights are usually powered by batteries. The surge power applied to the lamps when the flash light is initially turned on may degrade the life time of the lamps. One of the common solutions is to add a current limiting resistor between the lamp and the battery. However, the power dissipation of the resistor may shorten the battery life.

Figure 7A:
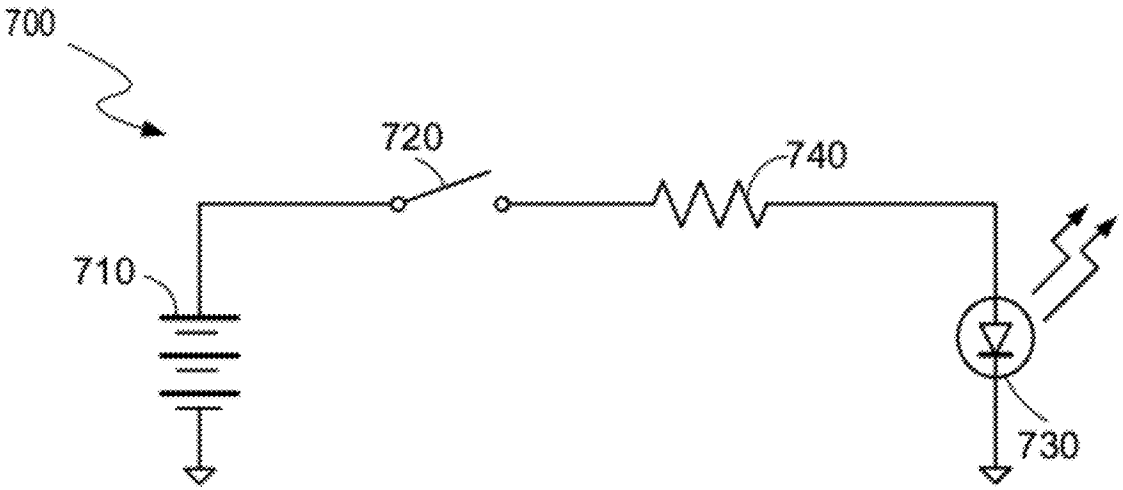
FIG. 7A PRIOR ART
FIG. 7A shows a conventional driving circuit used in a flash light.

The LED generally has a forward voltage between 3.2V to 4.0V when conducted. An alkaline battery cell for home appliances normally provides a voltage of 1.5V. Therefore, it may require at least three alkaline battery cells to power an LED. FIG. 7A shows a circuit 700 used in a conventional flash light. The circuit 700 uses a battery pack 710 including three series-connected cells as a power source. Each cell provides a voltage of 1.5V. The battery pack 710 powers an LED 730 via a switch 720. The LED 130 has a 3.2V forward voltage and a 100 mA current when conducted. The circuit 700 includes a current limiting resistor 740 (e.g., 13 Ohm) coupled between the LED 730 and the battery pack 710.

In operation, the power dissipation of the current limiting resistor 740 is approximately 0.13 Watt and the power dissipation of the LED 130 is approximately 0.32 Watt. As such, the power consumed by the LED 730 is approximately 71% of the total power provided by the battery pack 710. In other words, part of the battery power is wasted by the current limiting resistor 740. Thus, the battery pack 710 may need to provide sufficient power to maintain brightness of the LED 730, which may reduce the battery life.

Due to manufacturing process or other factors, the LED 730 may have a forward voltage of 4.0V when conducted. Thus, the current flowing through the LED 730 will be limited to approximately 38.5 mA, which is approximately 38.5% of the rated current (100 mA). Accordingly, the brightness of the LED 730 may be reduced to 38.5% of the expected brightness. The resistance of the resistor 740 can be changed from 13 Ohm to 5 Ohm to yield a current of 100 mA flowing through the LED 730 such that the LED 730 can have the expected brightness (the brightness when the LED current is 100 mA). However, if the resistance of the resistor 740 is 5 Ohm, the circuit 700 may overdrive the LEDs which have lower forward voltages. For example, for an LED having a forward voltage of 3.2V, the current flowing through the LED is approximately 260 mA which can be greater than a rated current of the LED. Consequently, the LED life time may be shortened.

Figure 7B:
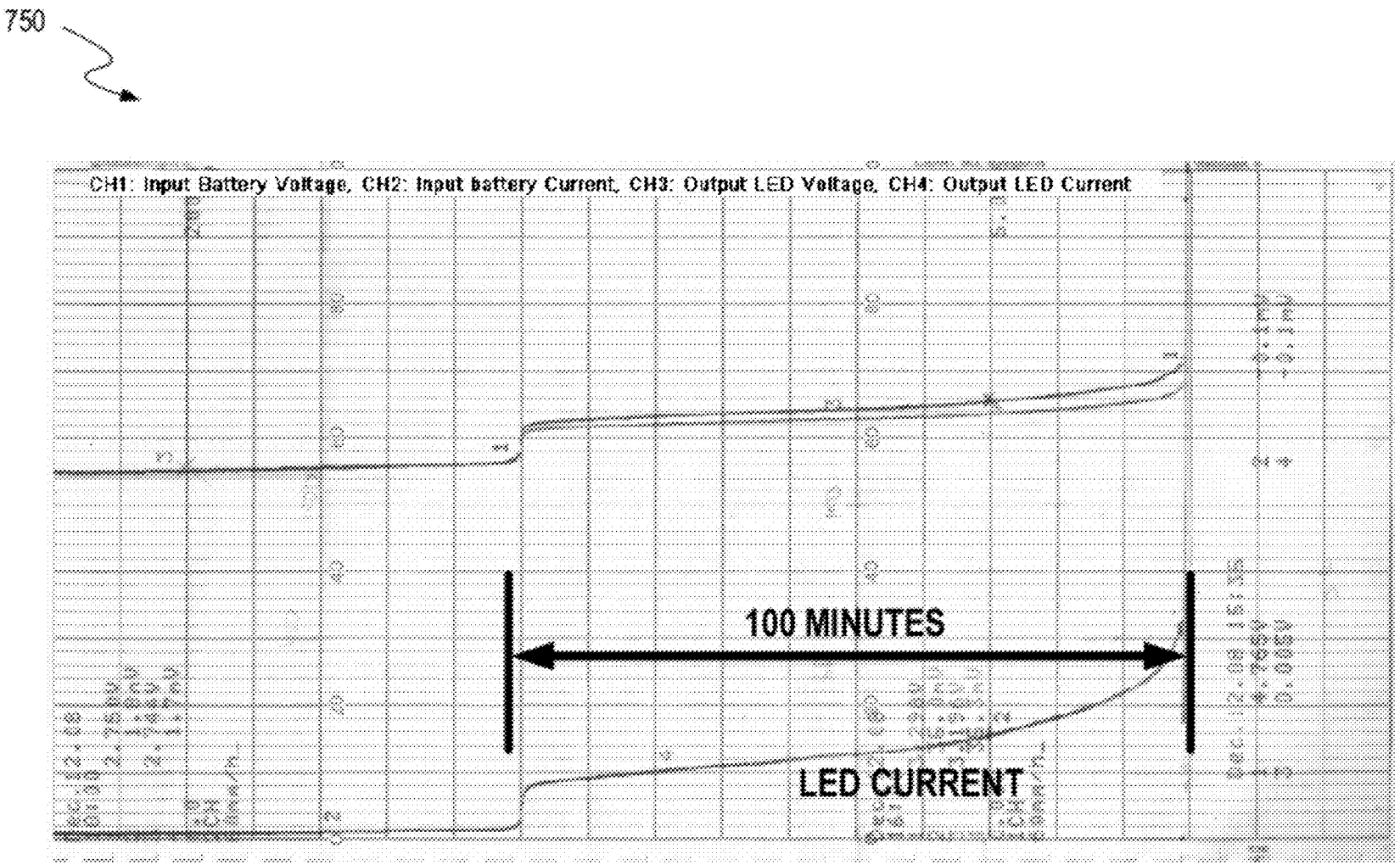
FIG. 7B PRIOR ART
FIG. 7B shows a graph illustrating the performance of the conventional driving circuit in FIG. 7A.

FIG. 7B shows a graph 750 illustrating the performance of the conventional circuit shown in FIG. 7A. The conventional circuit utilizes two 1.5V alkaline battery cells together with a current limiting resistor to drive an LED having a 100 mA rated current. As shown in the graph 750, the run time of the battery cells in this conventional circuit is only approximately 100 minutes.

Furthermore, the conventional circuit 700 is limited in practical applications when a user uses different LEDs with different power ratings. For example, the user may replace the LED having a 100 mA rated current with an LED having a 1 A rated current with the expectation of obtaining greater power. Unfortunately, since the current limiting resistor has fixed resistance, the current flowing through the LED will not be changed. Moreover, the number of battery cells is usually determined by the shape of the flash light and cannot be changed after production. Generally speaking, such conventional circuit using a current limiting resistor has lower power efficiency, lacks flexibility, and may not be practical for different applications.

Figure 8:
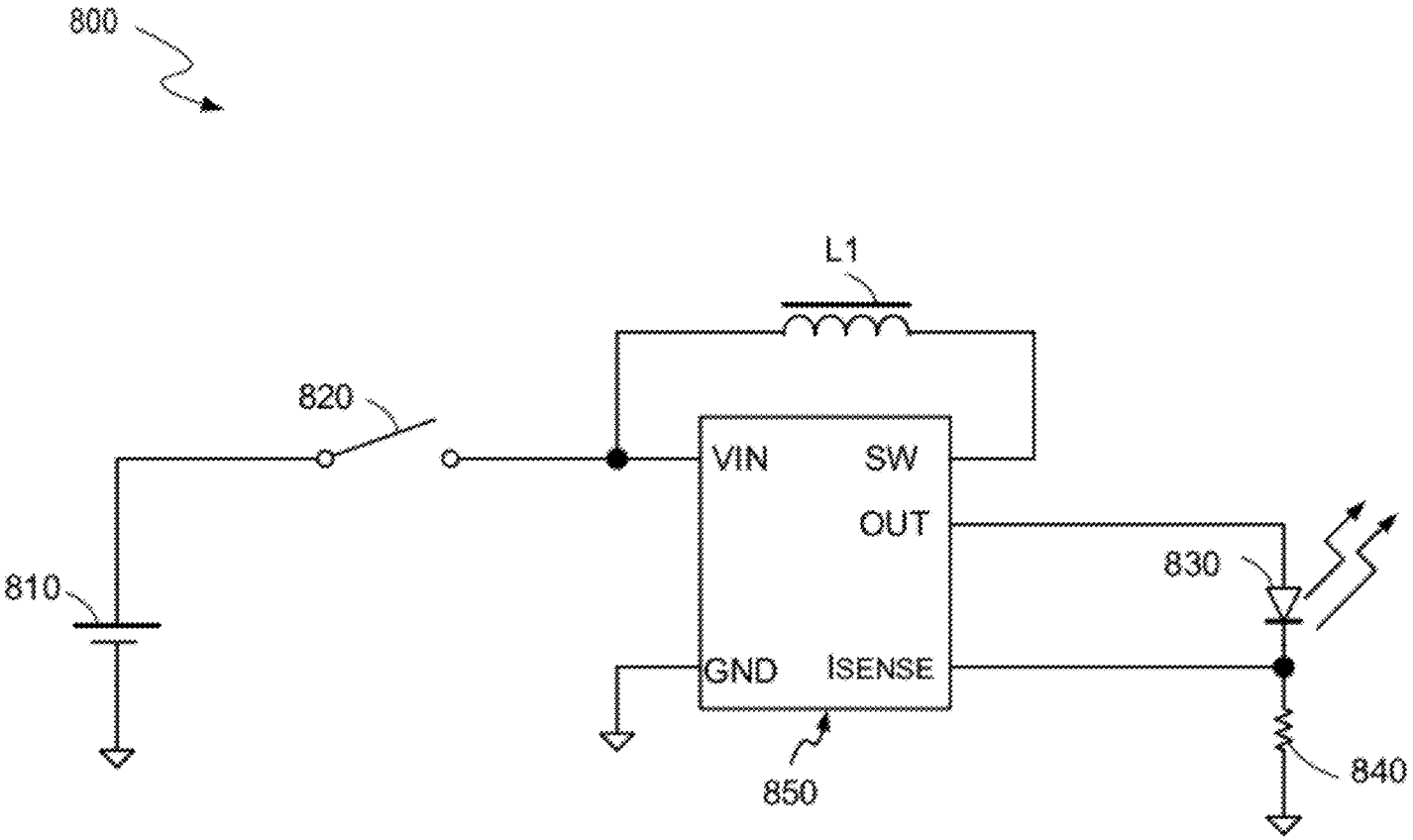
FIG. 8 shows a driving circuit in a portable lighting device, in accordance with one embodiment of the present invention.

FIG. 8 shows a driving circuit 800 in a portable lighting device, in accordance with one embodiment of the present invention. In one embodiment, the portable lighting device can be a flash light. The circuit 800 includes a power source 810 operable for providing a voltage Vbatt, a switch 820, a load such as a light source 830, a sensor 840, a controller 850 and an inductor L1. However, the invention is not so limited; the circuit 800 can include any number of loads or light sources. In one embodiment, the power source 810 can be one or more alkaline battery cells. In one embodiment, the light source 830 can be an LED. In one embodiment, the controller 850 can be an integrated circuit (IC). In one embodiment, the controller 850 can include a power input terminal VIN for receiving input power from the power source 810, a power output terminal OUT for providing output power, a terminal ISENSE for receiving a feedback signal, a terminal GND coupled to ground, and an output switching terminal SW coupled to the power input terminal Vin through the inductor L1.

In one embodiment, the power input terminal VIN of the controller 850 is coupled to the power source 810 through the switch 820. The power output terminal OUT is coupled to the light source 830. The sensor 840 is coupled to the light source 830 in series for providing the feedback signal indicating an electrical characteristic of the light source 830. In one embodiment, the electrical characteristic of the light source 830 includes a level of the current flowing through the light source 830. The feedback signal is sent to the terminal ISENSE of the controller 850.

In one embodiment, the inductor L1 functions as an energy storage element of a boost converter. If the switch 820 is turned on, the controller 850 is coupled to the power source 810 via the power input terminal VIN for receiving the power supplied by the power source 810. The light source 830 can be powered via the power output terminal OUT of the controller 850. If the switch 820 is turned off, the power from the power source 810 can be cut off. In one embodiment, the controller can adjust the power supplied to the light source 830 based on the feedback signal received at the terminal ISENSE and a conduction status, e.g., the on/off status, of the switch 820.

Figure 9:
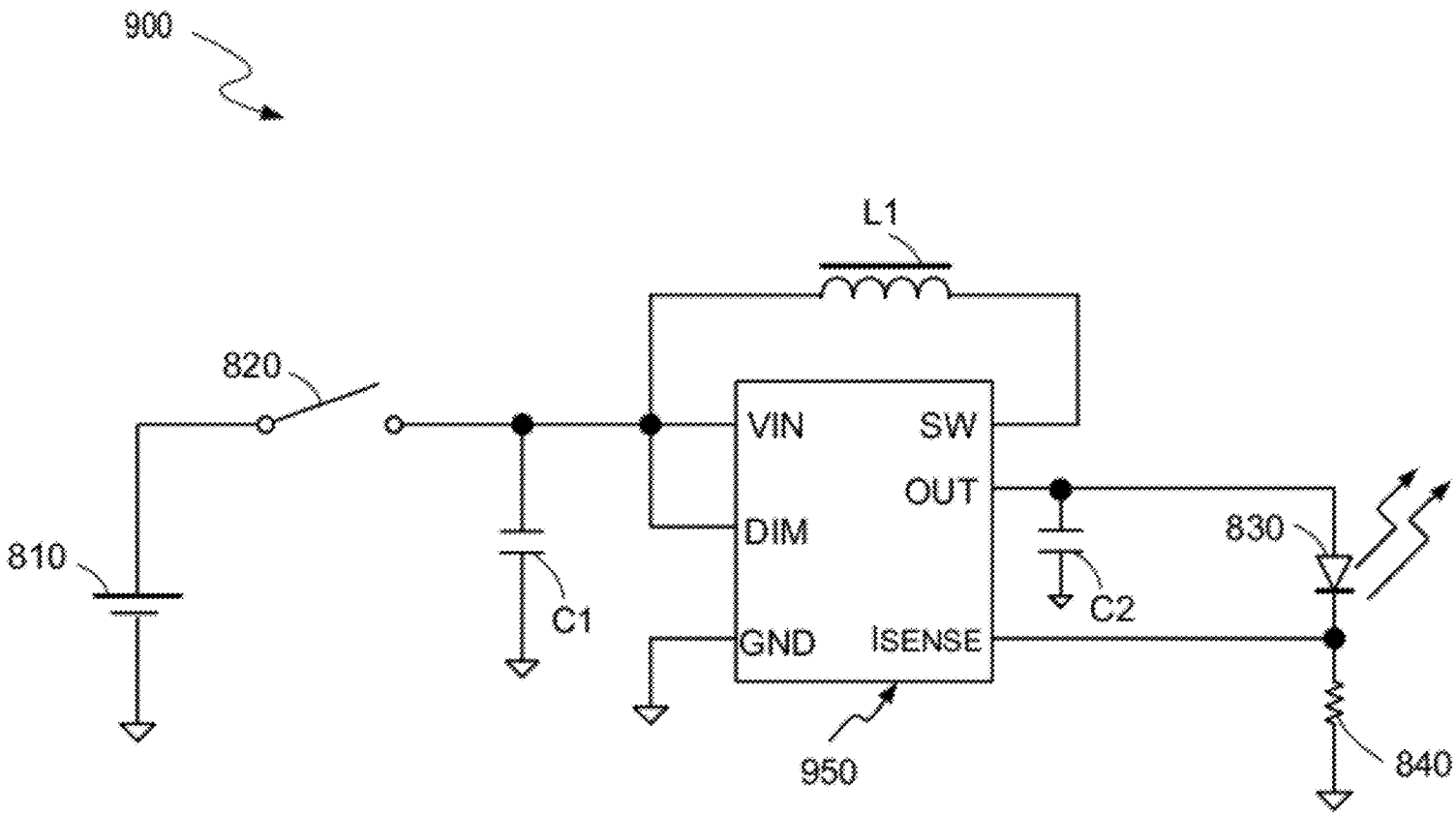
FIG. 9 shows a driving circuit in a portable lighting device, in accordance with one embodiment of the present invention.

FIG. 9 shows a driving circuit 900 in a portable lighting device, in accordance with one embodiment of the present invention. The circuit 900 includes a power source 810, a switch 820, a light source 830, a sensor 840, a controller 950, and an inductor L1. Elements labeled the same as in FIG. 8 have similar functions and will not be detailed described herein.

In one embodiment, the controller 950 can be an integrated circuit. In one embodiment, the circuit 900 further includes a capacitor C1 coupled between the power source 810 and the power input terminal VIN of the controller 950. In one embodiment, the circuit 900 further includes a capacitor C2 coupled between the light source 830 and the power output terminal OUT of the controller 950. In one embodiment, the controller 950 includes a terminal DIM coupled to the switch 820 for monitoring the on/off status of the switch 820.

In one embodiment, the controller 350 can adjust the power of the light source 830 based on the input at the terminal DIM. Accordingly, the brightness of the light source 830 can be adjusted by the controller 950. In one embodiment, the controller 950 adjusts the power of the light source 830 if the switch 820 is turned on.

Figure 10A:
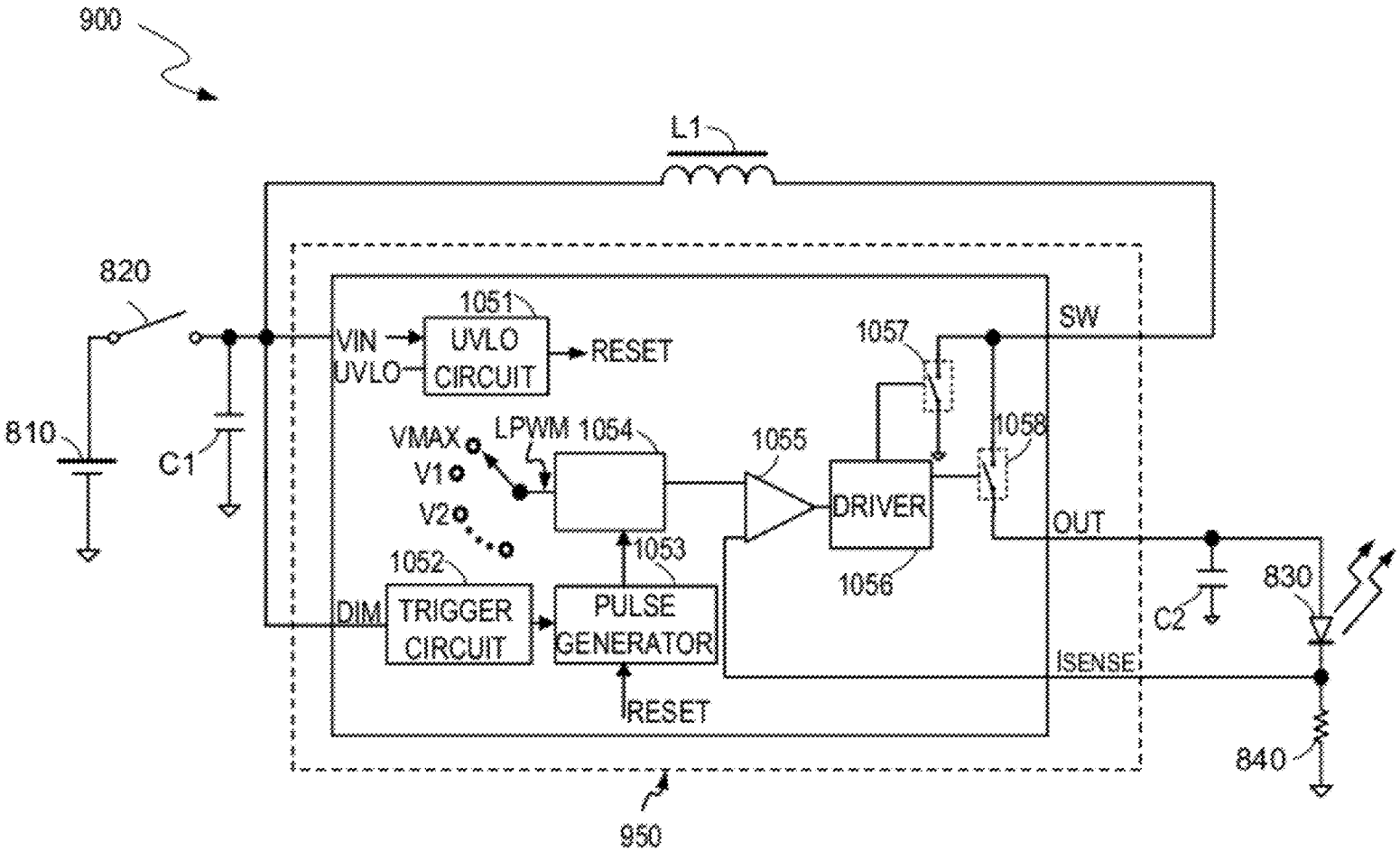
FIG. 10A shows a structure of the controller 950 in FIG. 9, in accordance with one embodiment of the present invention.
Figure 10B:
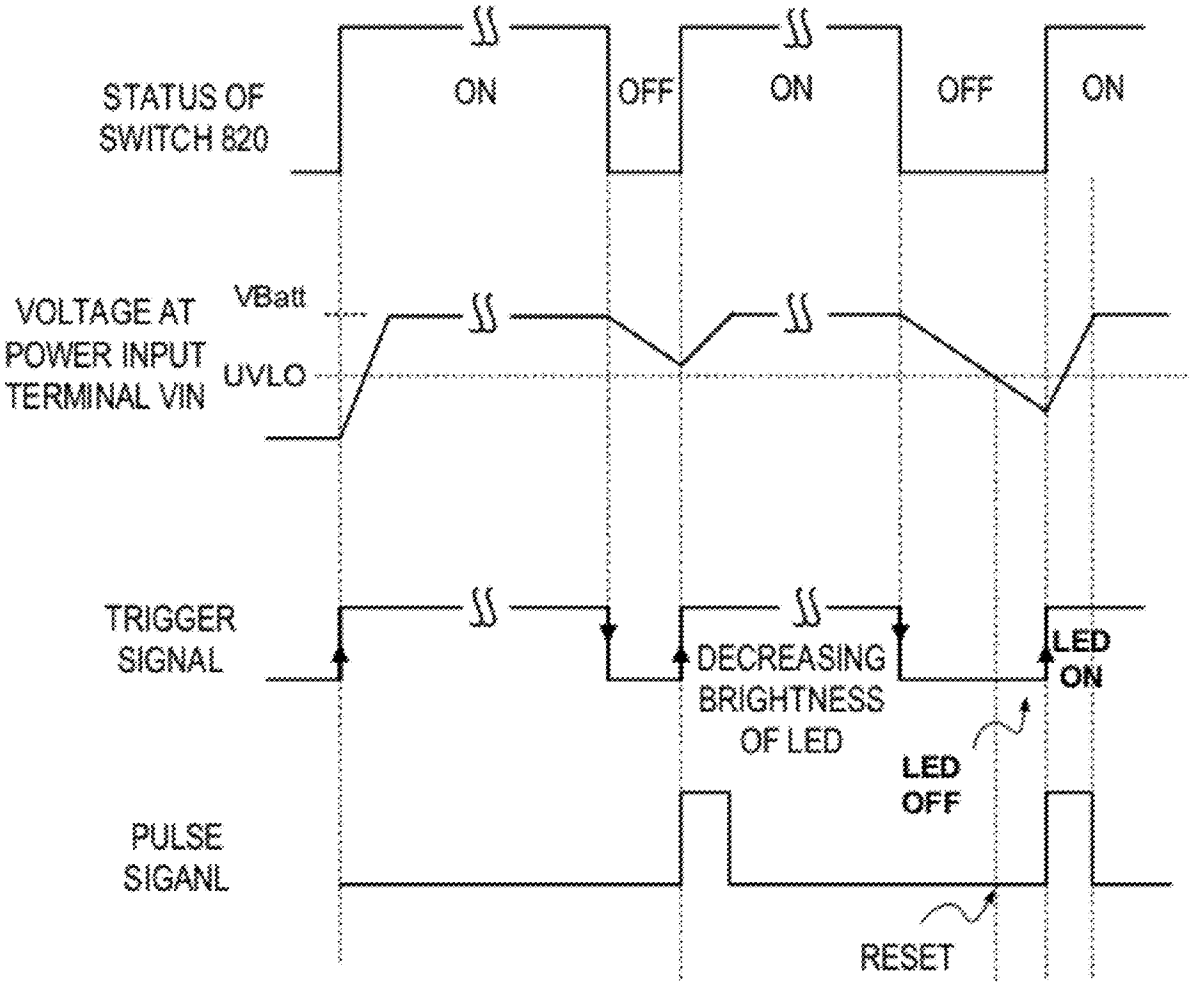
FIG. 10B shows a sequence diagram of the circuit 900 in FIG. 10A, in accordance with one embodiment of the present invention.

FIG. 10A shows a structure of the controller 950 in FIG. 9, in accordance with one embodiment of the present invention. Elements labeled the same as in FIG. 9 have similar functions. In one embodiment, the controller 950 can include an under voltage lockout (UVLO) circuit 1051, a trigger circuit 1052, a pulse generator 1053, a reference selection circuit 1054, a dimming unit 1055, a driver 1056, a switch 1057, and a switch 1058. FIG. 10B shows a sequence diagram of the circuit 900 in FIG. 10A. FIG. 10A is described in combination with FIG. 10B.

If the switch 820 is turned on, the power from the power source 810 is supplied to the power input terminal VIN of the controller 950. The light source 830 can be powered by a rated current. In one embodiment, the reference selection circuit 1054 can generate a reference signal LPWM. In one embodiment, the reference signal LPWM can have different levels, e.g., Vmax, V1, V2, etc., where Vmax>V1>V2. Each voltage level of the reference signal LPWM can correspond to a brightness level of the light source 830. The dimming unit 1055 can adjust the brightness of the light source 830 based on the voltage level of the reference signal LPWM. Initially, the reference selection circuit 1054 can generate the reference signal LPWM having the level of Vmax, in one embodiment. Accordingly, the dimming unit 1055 can initially adjust the brightness of the light source 830 to a maximum brightness (e.g., 100% brightness).

If the switch 820 is turned off, the power from the power source 810 to the controller 950 is cut off. In response, the trigger circuit 1052 generates a trigger signal having a first falling edge. The controller 950 can be powered by the energy stored in the capacitor C1. Therefore, during a certain time period after the switch 820 is turned off, the voltage at the power input terminal VIN will not decrease to a predetermined voltage, e.g., an under voltage lockout (UVLO) threshold. If the switch 820 is turned on during such time period (e.g., before the voltage at the terminal VIN drops below the UVLO threshold), the trigger circuit 1052 generates a trigger signal having a first rising edge. Accordingly, the pulse generator 1053 can generate a first pulse in response to the first rising edge of the trigger signal. The first pulse is applied to the reference selection circuit 1054. The reference selection circuit 1054 can generate the reference signal LPWM having a level of V1 according to the first pulse, in one embodiment. In one embodiment, the voltage V1 can be lower than the voltage Vmax. For example, by setting the reference signal LPWM at V1, the light source 830 can have a 75% brightness. The level of V1 can be predetermined according to different application requirements.

In one embodiment, if the switch 820 is turned off again, the trigger circuit 1052 generates a trigger signal having a second falling edge. During a certain time period before the voltage at the power input terminal VIN decreases to the UVLO threshold, if the switch 820 is turned on again, the trigger circuit 1052 generates a trigger signal having a second rising edge. Accordingly, the pulse generator 1053 can generate a second pulse in response to the second rising edge of the trigger signal. The second pulse is sent to the reference selection circuit 1054. The reference selection circuit 1054 can generate the reference signal LPWM having a level of V2 according to the second pulse, in one embodiment. In one embodiment, the voltage V2 can be lower than the voltage V1. For example, by setting the reference signal LPWM at V2, the light source 830 can have a 50% brightness. In another embodiment, the voltage V2 can be higher than the voltage V1 and lower than the voltage Vmax. For example, by setting the reference signal LPWM at V2, the light source 830 can have a 80% brightness.

The operation of adjusting the brightness of the light source 830 described above can be repeated if the switch 820 is turned on and turned off repeatedly. The voltage levels of the reference signal LPWM, e.g., Vmax, V1, V2, etc., can be predetermined and can be preconfigured. In one embodiment, the voltage of the reference signal LPWM can be sequentially decreased from 100% to 75%, to 50%, and then to 25% in response to four consecutive pulses which are generated by the pulse generator 453. In another embodiment, the voltage of the reference signal LPWM can be sequentially increased from 25% to 50%, to 75%, and then to 100% in response to four consecutive pulses from the pulse generator 1053. In one embodiment, the voltage of the reference signal LPWM can be adjusted such that the brightness of the light source 830 can be adjusted linearly, e.g., from 25% to 50%, to 75%, and then to 100%. In another embodiment, the voltage of the reference signal LPWM can be adjusted such that the brightness of the light source 830 can be adjusted non-linearly, e.g., from 20% to 30%, to 80%, and then to 100%. In yet another embodiment, the voltage of the reference signal LPWM can be adjusted such that the brightness of the light source 830 can be adjusted from 100% to 50%, and then to 100% to represent an SOS signal.

In one embodiment, the dimming unit 1055 can generate a dimming signal to adjust the current flowing through the light source 830 by adjusting the output power at the power output terminal OUT. The dimming signal can be generated according to the voltage of the reference signal LPWM and the feedback signal from the sensor 840. As a result, the brightness of the light source 830 can be adjusted accordingly. In one embodiment, the sensor 840 can be a resistor. In another embodiment, the sensor 840 can be a combination of a resistor and a capacitor (not shown in FIG. 10A).

In one embodiment, the output of the dimming unit 1055 can be amplified by the driver 1056. In one embodiment, the output of the driver 1056 is coupled to the switch 1057 to control the switch 1057 such that the power from the power source 810 and the power stored in the capacitor C1 can be selectively applied to the power output terminal OUT. In one embodiment, the dimming unit 1055 can be a pulse width modulation (PWM) circuit. In another embodiment, the dimming unit 1055 can be a pulse frequency modulation (PFM) circuit.

In one embodiment, the switch 1057, the switch 1058, the capacitor C2 and the inductor L1 constitute a boost converter which can boost the voltage at the power output terminal OUT to a voltage that is high enough to drive the light source 830. In one embodiment, the output switching terminal SW is coupled to the power input terminal Vin through the inductor L1, and is coupled to ground through the switch 1057. The output switching terminal SW is also coupled to the power output terminal OUT through the switch 1058. The power output terminal OUT is coupled to the capacitor C2. As such, even if the power source 810 provides a relatively low voltage, e.g., 1V, the boost converter can provide an increased voltage at the power output terminal OUT to drive the light source 830. Furthermore, the power of the light source 830 can be adjusted by the controller 950. Therefore, the run time as well as the life time of the power source 810 can be extended.

In one embodiment, the switch 1057 and the switch 1058 can be metal oxide semiconductor field effect transistors (MOSFET). In one embodiment, the switch 1057 and the switch 1058 can operate in a complimentary mode. In other words, the switch 1057 and the switch 1058 can be alternately turned on and off. In one embodiment, the switch 1057 can be an N-channel MOSFET. In one embodiment, the switch 1058 can be a P-channel MOSFET. In another embodiment, the switch 1058 can be a diode.

If the switch 820 is turned off for a time period long enough that the voltage at the power input terminal VIN drops below a predetermined voltage, e.g., the UVLO threshold, the UVLO circuit 1051 can generate a UVLO signal such as a reset signal. The reset signal can reset the pulse generator 1053 and can turn off the light source 830. The light source 830 remains off until the switch 820 is turned on again.

Figure 11:
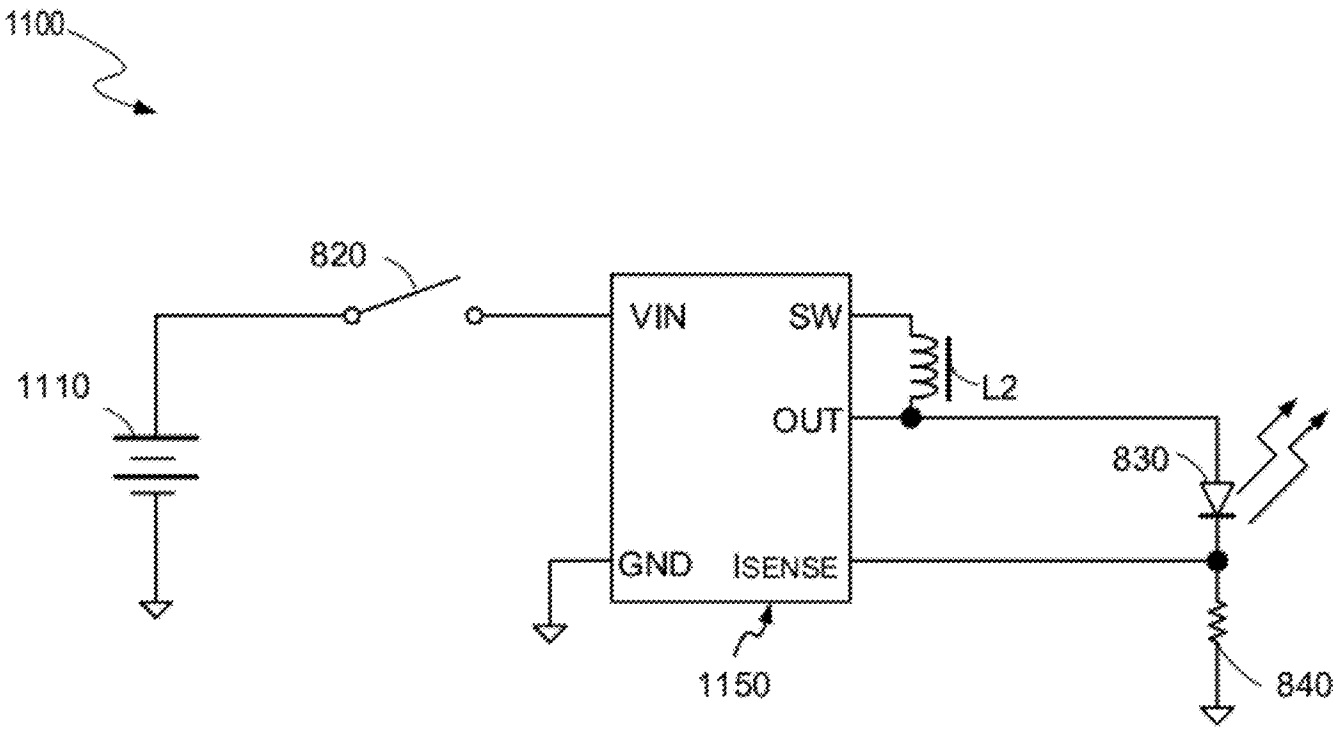
FIG. 11 shows a driving circuit in a portable lighting device, in accordance with one embodiment of the present invention.

FIG. 11 shows a driving circuit 1100 in a portable lighting device, in accordance with one embodiment of the present invention. In one embodiment, the circuit 1100 can include a power source 1110, a switch 820, a light source 830, a sensor 840, a controller 1150 and an inductor L2. In one embodiment, the power source 1110 can be one or more alkaline battery cells. In one embodiment, the light source 830 can be an LED. In one embodiment, the controller 1150 can be an integrated circuit. Elements labeled the same as in FIG. 8 have similar functions and will not be detailed described herein.

In one embodiment, the inductor L2 functions as an energy storage element of a buck convertor. When the switch 820 is turned on, the power input terminal VIN of the controller 1150 is coupled to the power source 1110. The power from the power output terminal OUT of the controller 1150 is supplied to the light source 830. If the switch 820 is turned off, the power from the power source 1110 to the controller 1150 is cut off. In one embodiment, the controller 1150 can adjust the power supplied to the light source 830 based on the feedback signal received at the terminal ISENSE and the on/off status of the switch 820.

Figure 12:
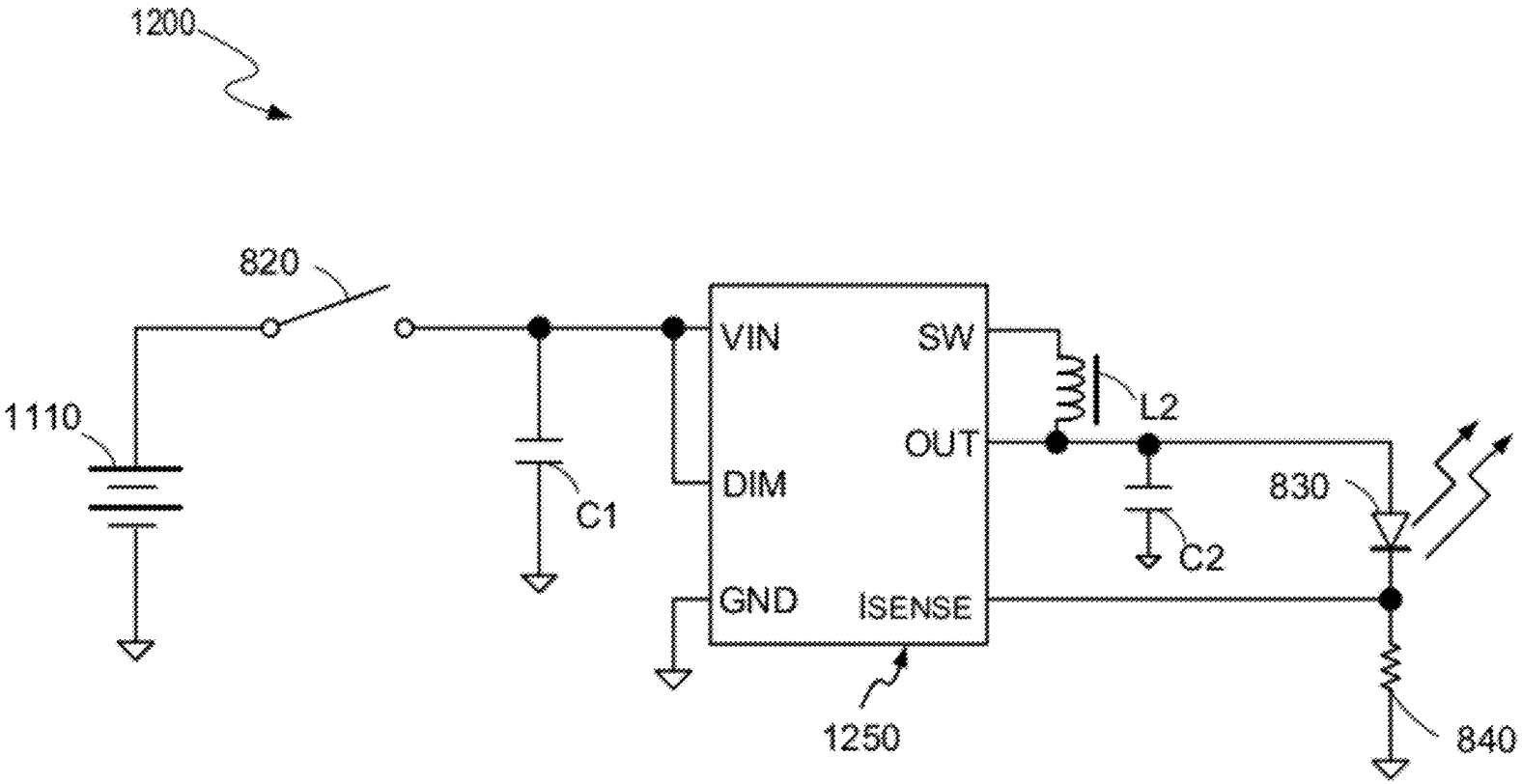
FIG. 12 shows a driving circuit in a portable lighting device, in accordance with one embodiment of the present invention.

FIG. 12 shows a driving circuit 1200 in a portable lighting device, in accordance with one embodiment of the present invention. In one embodiment, the circuit 1200 can include a power source 1110, a switch 820, a light source 830, a sensor 840, a controller 1250, an inductor L2, a capacitor C1, and a capacitor C2. Elements labeled the same as in FIG. 11 have similar functions and will not be detailed described herein.

Figure 13:
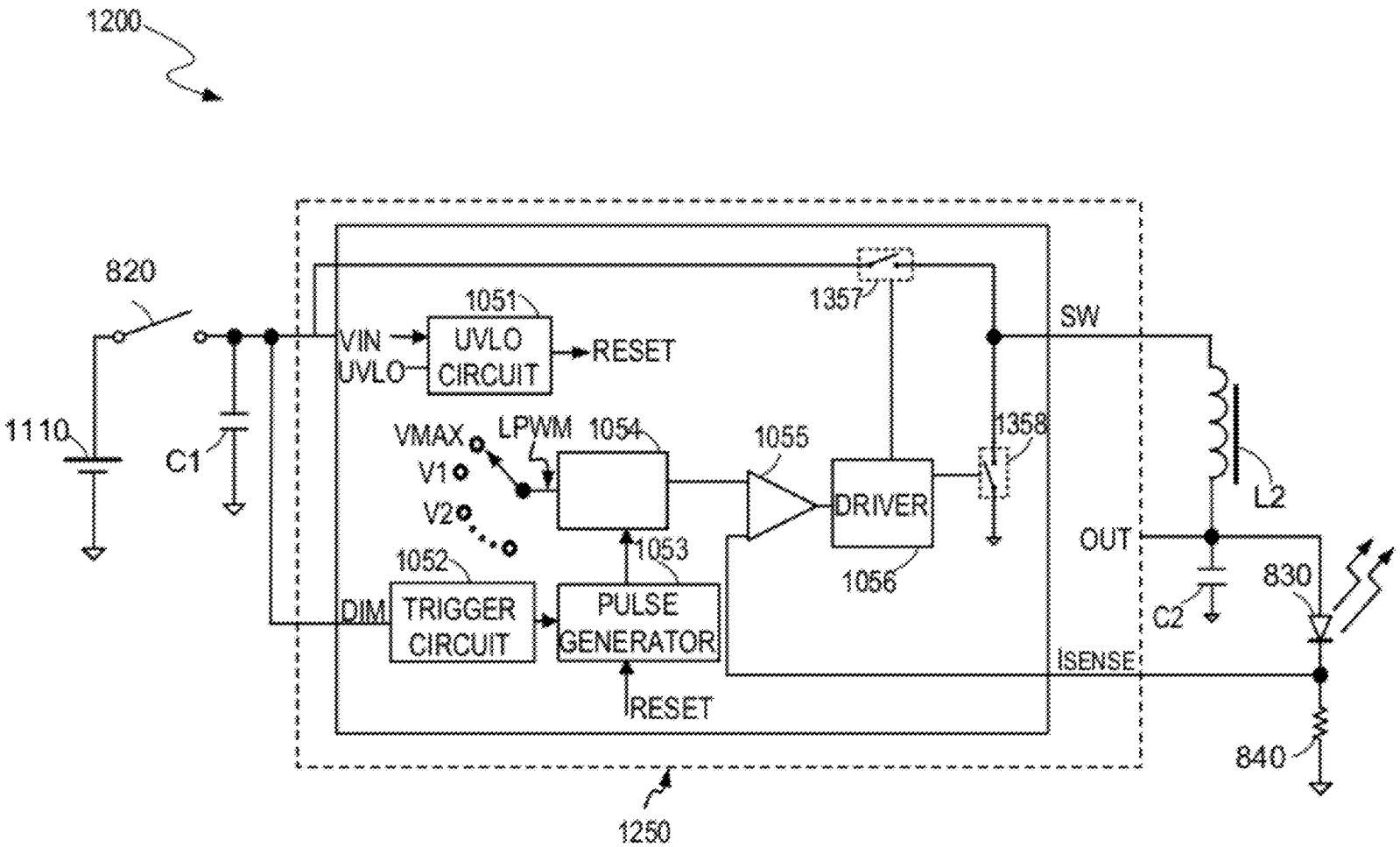
FIG. 13 shows a structure of the controller 1250 in FIG. 12, in accordance with one embodiment of the present invention.

FIG. 13 shows a structure of the controller 1250 in FIG. 12, in accordance with one embodiment of the present invention. In one embodiment, the controller 1250 can include a UVLO circuit 1051, a trigger circuit 1052, a pulse generator 1053, a reference selection circuit 1054, a dimming unit 1055, a driver 1056, a switch 1357 and a switch 1358. Elements labeled the same as in FIG. 10A have similar functions and will not be detailed described herein. The sequence diagram of the circuit 1200 is similar to the sequence diagram of the circuit 900 (shown in FIG. 10B) and will not be detailed described herein.

In one embodiment, the switch 1357, the switch 1358, the capacitor C2 and the inductor L2 constitute a buck converter which can reduce the voltage at the power output terminal OUT of the controller 1250 to a lower voltage to drive the light source 830. In one embodiment, the output switching terminal SW is coupled to the power input terminal VIN through the switch 1357. The output switching terminal SW is coupled to ground through the switch 1358. The output switching terminal SW is also coupled to ground through the inductor L2 and the capacitor C2. The power output terminal OUT of the controller 1250 is coupled to a node between the inductor L2 and the capacitor C2. Therefore, even if the voltage supplied by the power source 1110 is higher than a proper voltage (e.g., 6V) to drive the light source 830, the controller 1250 can drive the light source 830 with a reduced voltage provided by the buck converter. Furthermore, the power of the light source 830 can be adjusted by the controller 1250. Therefore, the run time as well as the life time of the power source 1110 can be extended.

In one embodiment, the switch 1357 and the switch 1358 can be MOSFETs. In one embodiment, the switch 1357 and the switch 1358 can operate in a complimentary mode. In other words, the switch 1357 and the switch 1358 can be alternately turned on and off. In one embodiment, the switch 1357 can be an N-channel MOSFET. In one embodiment, the switch 1358 can be a P-channel MOSFET. In another embodiment, the switch 1358 can be a diode.

Figure 14:
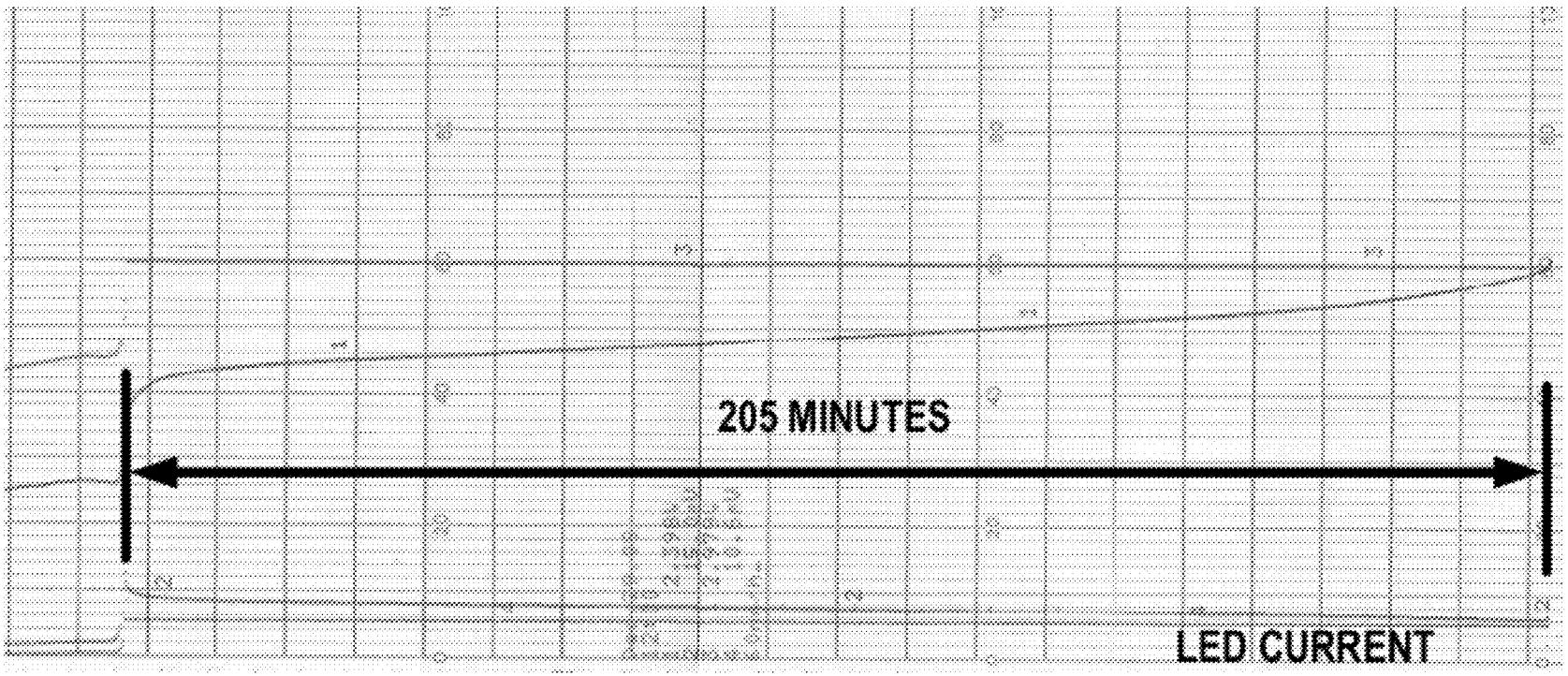
FIG. 14 shows a graph illustrating the performance of the driving circuit in FIG. 10A, according to one embodiment of the present invention.

FIG. 14 shows a graph illustrating performance of the circuit 900 in FIG. 10A, according to one embodiment of the present invention. By way of example, the circuit utilizes two 1.5V alkaline battery cells to drive an LED having a 100 mA rated current. The waveform in FIG. 14 indicates the current flowing through the LED. By comparing FIG. 14 and FIG. 7B, it shows that if the current flowing through the LEDs are of the same level (the brightness of the LEDs are the same), the battery run time of a conventional circuit is only approximately 100 minutes (shown in FIG. 7B), while the battery run time in the circuit according to the present invention is approximately 205 minutes. As a result, the run time as well as the life time of the battery can be extended and the number of battery cells can be reduced.

Figure 15:
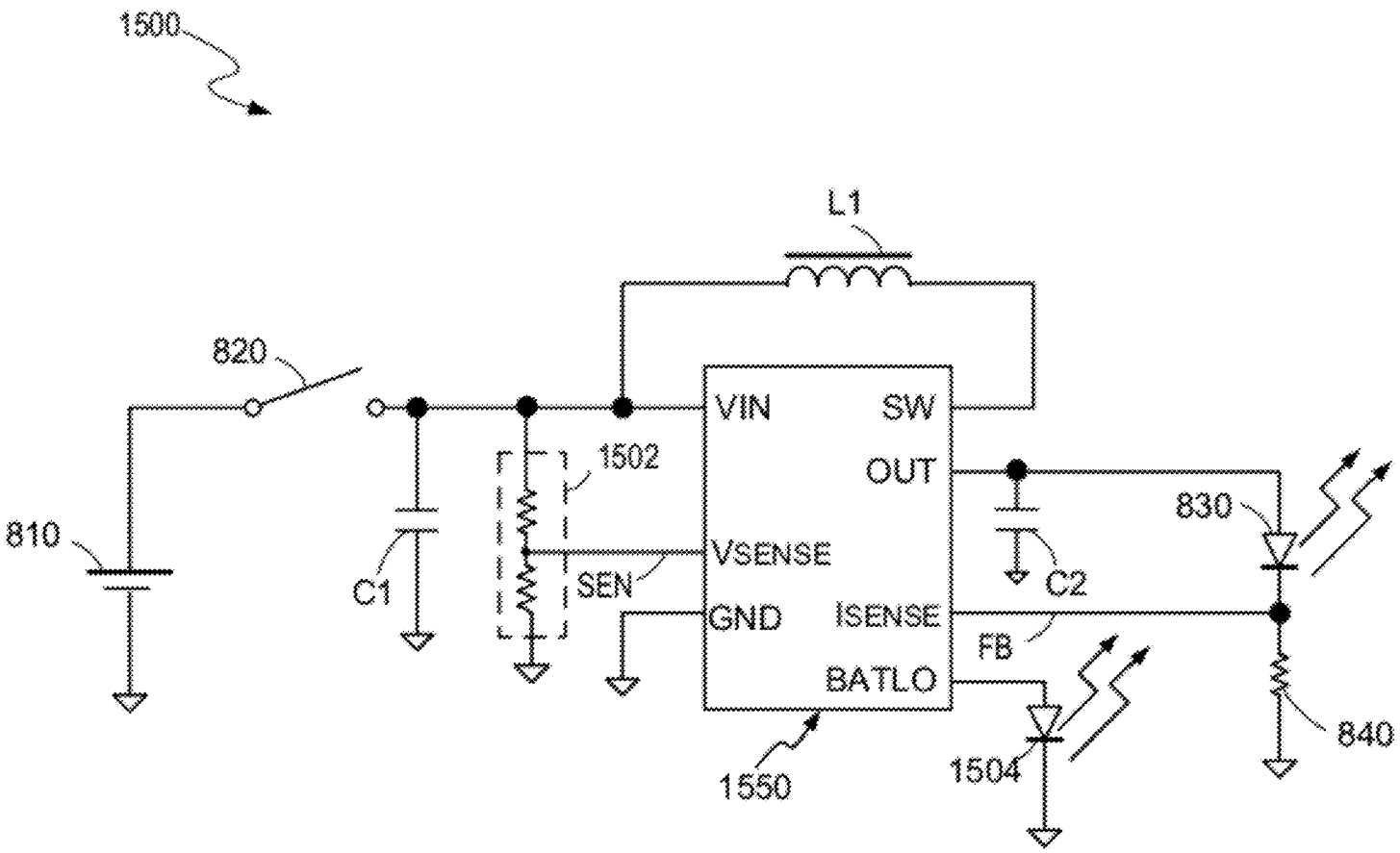
FIG. 15 shows a driving circuit in a portable lighting device, in accordance with one embodiment of the present invention.

FIG. 15 shows a driving circuit 1500, e.g., in a portable lighting device, in accordance with one embodiment of the present invention. The circuit 1500 includes a power source 810, a switch 820, a light source 830, a sensor 840, a controller 1550, and an inductor L1. Elements labeled the same as in FIG. 8 have similar functions.

In one embodiment, the controller 1550 includes a power input terminal VIN coupled to the power source 810 through the switch 820, a sensing terminal $V_{SENSE}$ coupled to the power source 810 through a voltage divider 1502 and the switch 820, a power output terminal OUT coupled to the light source 830, a feedback terminal $I_{SENSE}$ coupled to the sensor 840, a terminal GND coupled to ground, an output switching terminal SW coupled to the power input terminal VIN through the inductor L1, and an indication terminal BATLO coupled to an indicator 1504. In one embodiment, the circuit 900 further includes a capacitor C1 coupled between the power source 810 and the power input terminal VIN of the controller 1550. In one embodiment, the circuit 1500 further includes a capacitor C2 coupled between the light source 830 and the power output terminal OUT of the controller 1550.

In operation, if the switch 820 is turned on, the power input terminal VIN receives a voltage from the power source 810, the sensing terminal $V_{SENSE}$ receives a sensing signal SEN indicating a voltage of the power source 810, the power output terminal OUT provides an output power to the light source 830, the feedback terminal $I_{SENSE}$ receives a feedback signal FB indicating an instant current of the light source 830. The controller 1550 regulates a current of the light source 830 based on the feedback signal FB and the sensing signal $V_{SENSE}$. More specifically, the controller 1550 regulates the current of the light source 830 to a first current level if the sensing signal SEN indicates that the voltage of the power source 810 is greater than a first voltage level. The controller 1550 regulates the current of the light source 830 to a second current level if the sensing signal SEN indicates that the voltage of the power source 810 is less than a second voltage level. The second voltage level is less than the first voltage level. The controller 1550 regulates the current of the light source 830 to vary according to the sensing signal SEN if the sensing signal SEN indicates that the voltage of the power source 810 is between the first voltage level and the second voltage level. Accordingly, the brightness of the light source 830 can be adjusted by the controller 1550.

Figure 16:
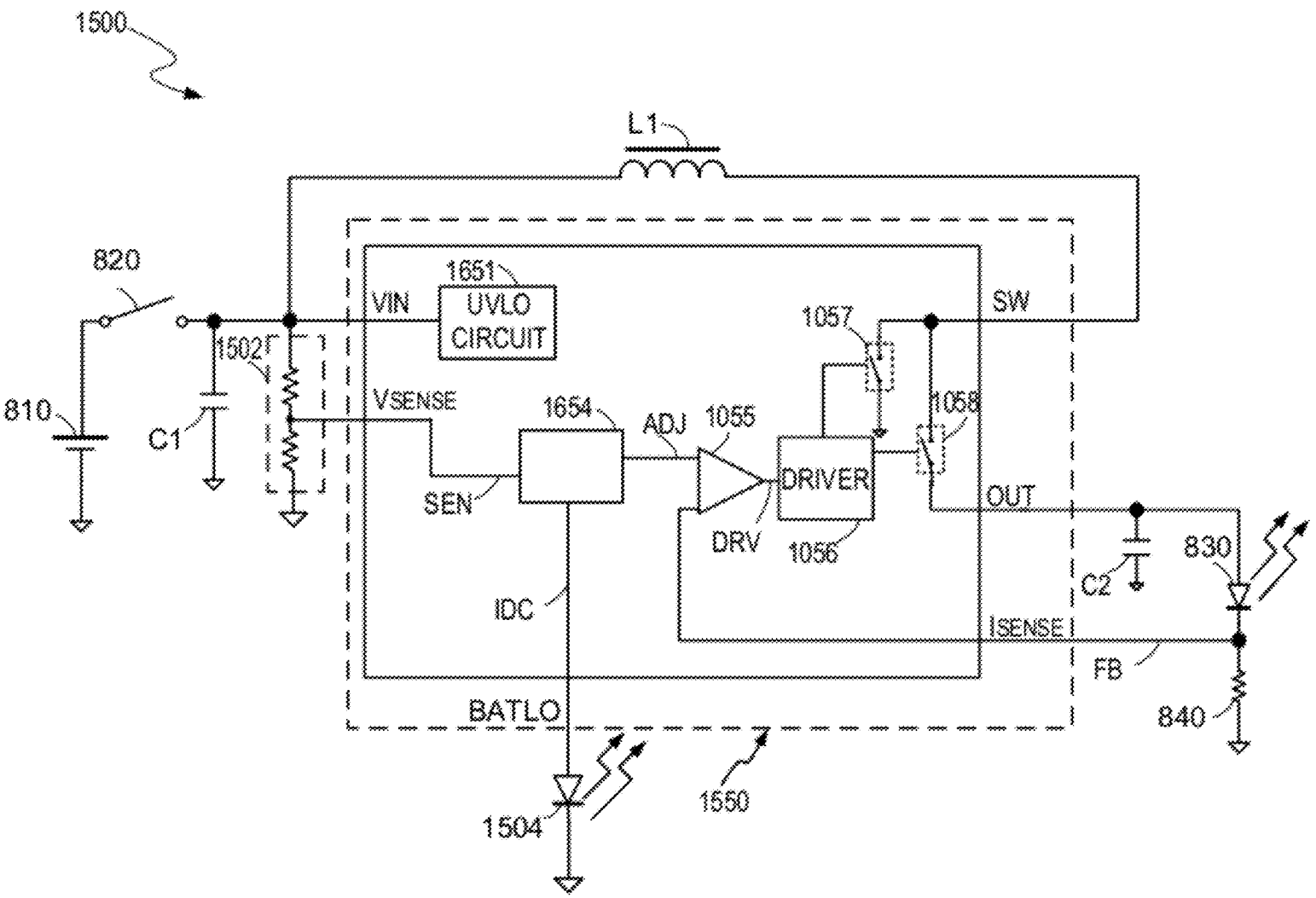
FIG. 16 shows a structure of the controller 1550 in FIG. 15, in accordance with one embodiment of the present invention.
Figure 17:
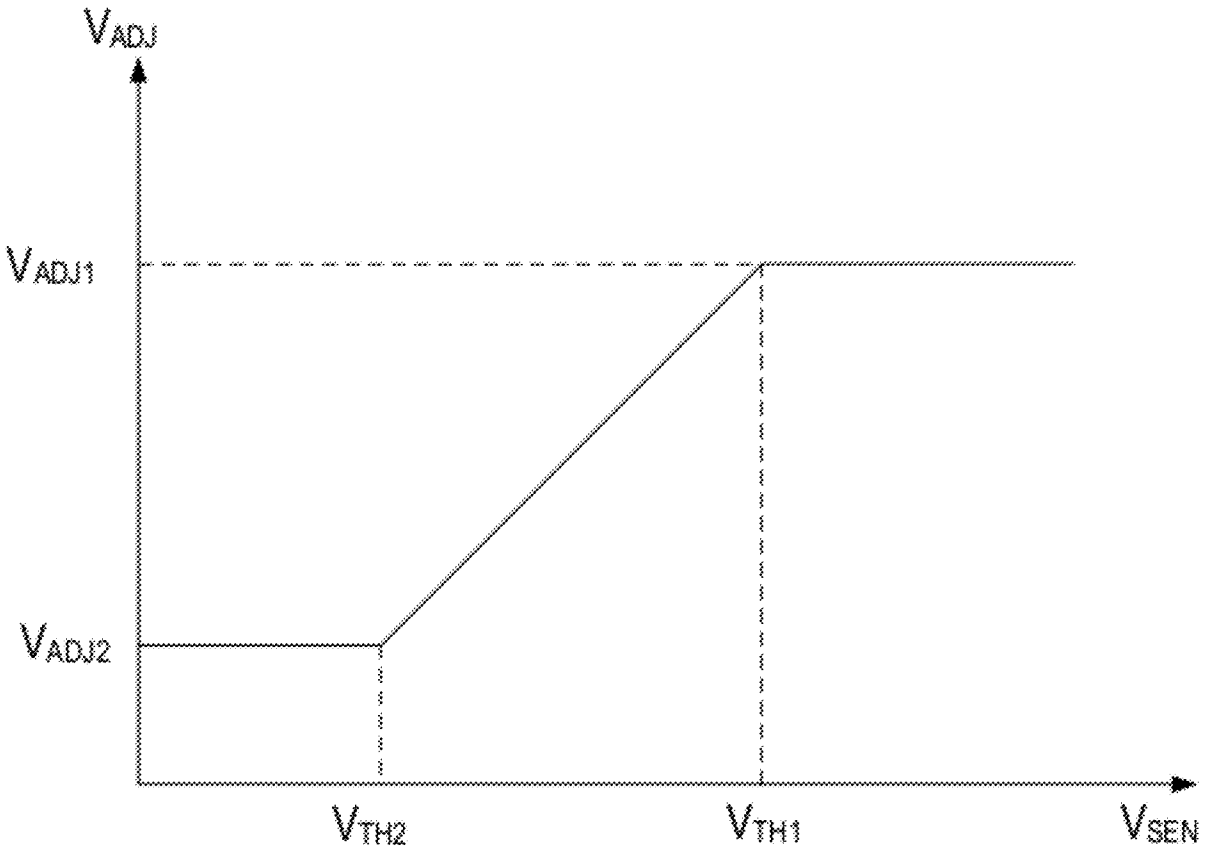
FIG. 17 illustrates an example of a diagram showing a relationship between a voltage of a reference signal ADJ and a voltage of a sensing signal SEN in FIG. 16, in accordance with one embodiment of the present invention.

FIG. 16 shows a structure of the controller 1550 in FIG. 15, in accordance with one embodiment of the present invention. Elements labeled the same as in FIG. 10A have similar functions. FIG. 17 illustrates an example of a diagram showing a relationship between a voltage of a reference signal ADJ and a voltage of a sensing signal SEN in FIG. 16, in accordance with one embodiment of the present invention. FIG. 16 is described in combination with FIG. 17. In one embodiment, as shown in FIG. 16, the controller 1550 includes an under voltage lockout (UVLO) circuit 1651 coupled to the input terminal VIN, a reference signal generating unit 1654 coupled to the sensing terminal $V_{SENSE}$, a dimming unit 1055 coupled to the reference signal generating unit 1654, a driver 1056 coupled to the dimming unit 1055, a switch 1057, and a switch 1058 coupled to the driver 1056.

If the switch 820 is turned on, the input terminal VIN receives a voltage from the power source 810. The reference signal generating unit 1654 generates a reference signal ADJ based on the sensing signal SEN. The reference signal ADJ indicates a target current level of the light source 830. The voltage $V_{SEN}$ of the sensing signal SEN is proportional to the voltage of the power source 810. A voltage $V_{ADJ}$ of the reference signal ADJ is at a first voltage level $V_{ADJ1}$ if a voltage $V_{SEN}$ of the sensing signal SEN is greater than a first level $V_{TH1}$. That the voltage $V_{SEN}$ of the sensing signal SEN is greater than the first level $V_{TH1}$ indicates that the voltage of the power source 810 is greater than the first voltage level. The voltage $V_{ADJ}$ of the reference signal ADJ is at a second voltage level $V_{ADJ2}$ if the voltage $V_{SEN}$ of the sensing signal SEN is less than a second level $V_{TH2}$. That the voltage $V_{SEN}$ of the sensing signal SEN is less than the second level $V_{TH2}$ indicates that the voltage of the power source 810 is less than the second voltage level. If the voltage $V_{SEN}$ of the sensing signal SEN is greater than the second level $V_{TH2}$ and less than the first level $V_{TH1}$, the voltage $V_{ADJ}$ of the reference signal ADJ varies linearly with the voltage $V_{SEN}$ of the sensing signal SEN, and therefore the current of the light source 830 is regulated to vary linearly with the voltage of the power source 810.

The dimming unit 1055 generates a dimming signal DRV based on the reference signal ADJ and the feedback signal FB to regulate the current of the light source 830. In the example of FIG. 16, the switch 1057, the switch 1058, the capacitor C2 and the inductor L1 constitute a boost converter which can boost the voltage at the power output terminal OUT to a voltage that is high enough to drive the light source 830. The output switching terminal SW is coupled to the power input terminal Vin through the inductor L1, and is coupled to ground through the switch 1057. The output switching terminal SW is also coupled to the power output terminal OUT through the switch 1058. The power output terminal OUT is coupled to the capacitor C2. As such, even if the power source 810 provides a relatively low voltage, e.g., 1V, the boost converter can provide an increased voltage at the power output terminal OUT to drive the light source 830. The driver 1056 controls the switch 1057 and the switch 1058 based on the dimming signal DRV. In one embodiment, the switch 1057 and the switch 1058 can operate in a complimentary mode. In other words, the switch 1057 and the switch 1058 can be turned on and off alternately. Accordingly, the current of the light source 830 is regulated to a target current level which is determined by the reference signal ADJ. Furthermore, the reference signal generating unit 1654 also generates an indication signal IDC based on the sensing signal SEN. The indication signal IDC is in a first state, e.g., logic high, if the sensing signal SEN indicates that the voltage of the power source 810 is less than the second voltage level. The indication signal IDC is in a second state, e.g., logic low, if the sensing signal SEN indicates that the voltage of the power source 810 is greater than the second voltage level. Accordingly, in one embodiment, the indicator 1054 is turned on if the indication signal IDC is in the first state to indicate that the voltage of the power source 810 is less than the second voltage level. The indicator 1054 is turned off if the indication signal IDC is in the second state to indicate that the voltage of the power source 810 is greater than the second voltage level. The UVLO circuit 1651 can turn off the controller 1550 if the voltage at the input terminal VIN is less than a turn-off threshold and can turn on the controller 1550 if the voltage at the input terminal VIN is greater than a turn-on threshold.

Figure 18:
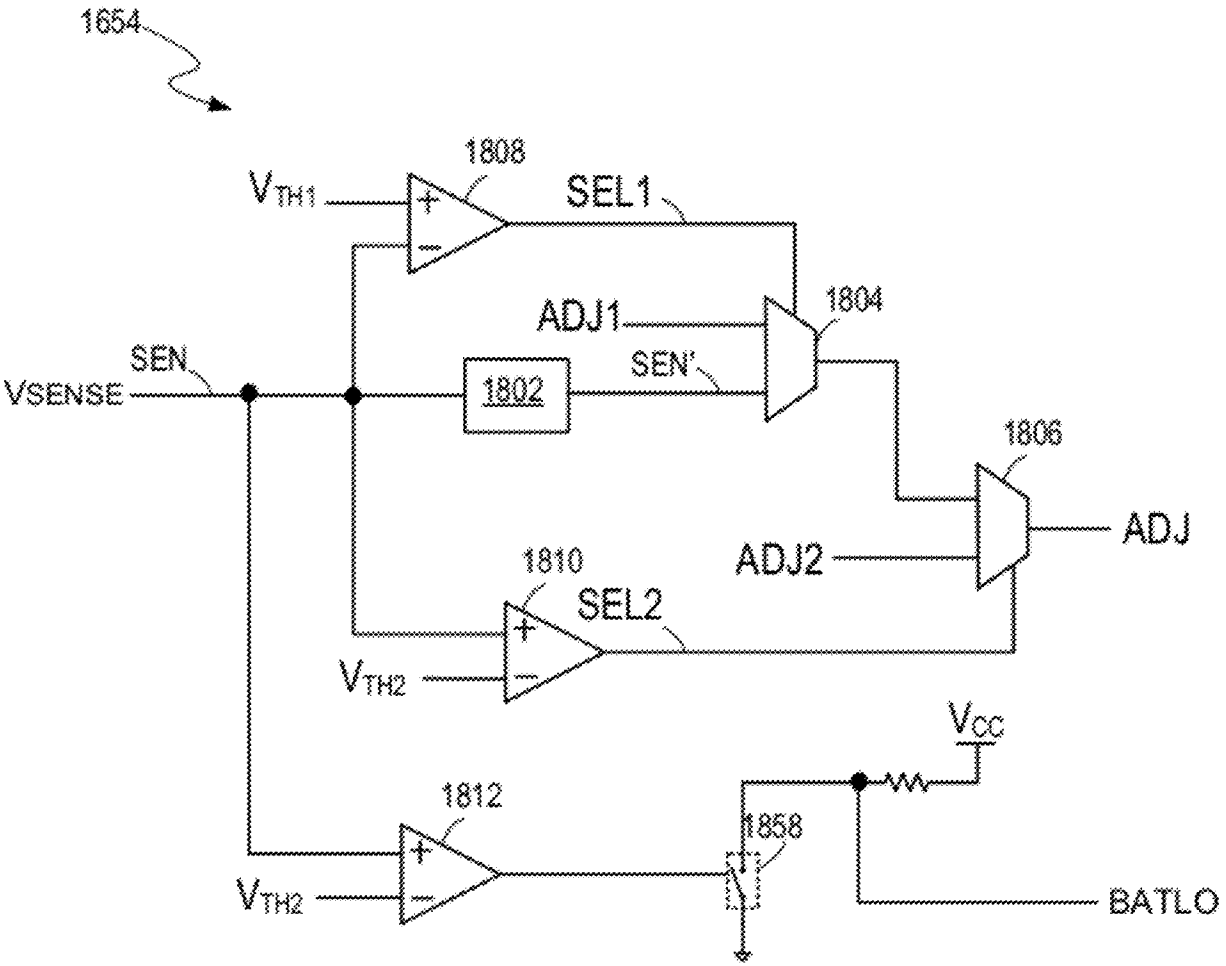
FIG. 18 shows a structure of the reference signal generation unit 1654 in FIG. 16, in accordance with one embodiment of the present invention.

FIG. 18 shows a structure of the reference signal generation unit 1654 in FIG. 16, in accordance with one embodiment of the present invention. The reference signal generation unit 1654 includes a first comparator 1808, a second comparator 1810, a first multiplexer 1804, a second multiplexer 1806, a sensing signal processing unit 1802, a third comparator 1812, and a switch 1858. The sensing signal processing unit 1802 provides a processed signal SEN' based on the sensing signal SEN. The processed signal SEN' is proportional to the sensing signal SEN.

In operation, the first comparator 1808 compares the sensing signal SEN with the first threshold $V_{TH1}$ to generate a first selection signal SEL1. The second comparator 1810 compares the sensing signal SEN with the second threshold $V_{TH2}$ to generate a second selection signal SEL2. The first multiplexer 1804 selectively outputs the processed signal SEN' or a first voltage signal ADJ1 according to the first selection signal SEL1. The second multiplexer 1806 selectively outputs an output of the first multiplexer 1804 or a second voltage signal ADJ2 according to the second selection signal SEL2. More specifically, if the voltage $V_{SEN}$ of the sensing signal SEN is greater than the first threshold $V_{TH1}$, the first multiplexer 1804 outputs the first voltage signal ADJ1. The second multiplexer 1806 outputs the output of the first multiplexer 1804 (i.e., the first voltage signal ADJ1) as the reference signal ADJ. If the voltage $V_{SEN}$ of the sensing signal SEN is less than the second threshold $V_{TH2}$, the second multiplexer 1806 outputs second voltage signal ADJ2 as the reference signal ADJ. If the voltage $V_{SEN}$ of the sensing signal SEN is greater than the second threshold $V_{TH2}$ and is less than the first threshold $V_{TH1}$, the first multiplexer 1804 outputs the processed signal SEN', and the second multiplexer 1806 outputs the output of the first multiplexer 1804 (i.e., the processed signal SEN'). As such, the voltage of the reference signal ADJ is proportional to the voltage of the sensing signal SEN, which in turn is proportional to the voltage of the power source 810.

If the voltage $V_{SEN}$ of the sensing signal SEN is less than the second threshold $V_{TH2}$, which indicates that the voltage of the power source 810 is less than the second voltage level, the third comparator 1812 turns off the switch 1858 to generate an indication signal having a first state, e.g., logic high, to turn on the indicator 1504. If the voltage $V_{SEN}$ of the sensing signal SEN is greater than the second threshold $V_{TH2}$, which indicates that the voltage of the power source 810 is greater than the first voltage level, the third comparator 1812 turns on the switch 1858 to generate an indication signal having a second state, e.g., logic low, to turn off the indicator 1504.

Figure 19:
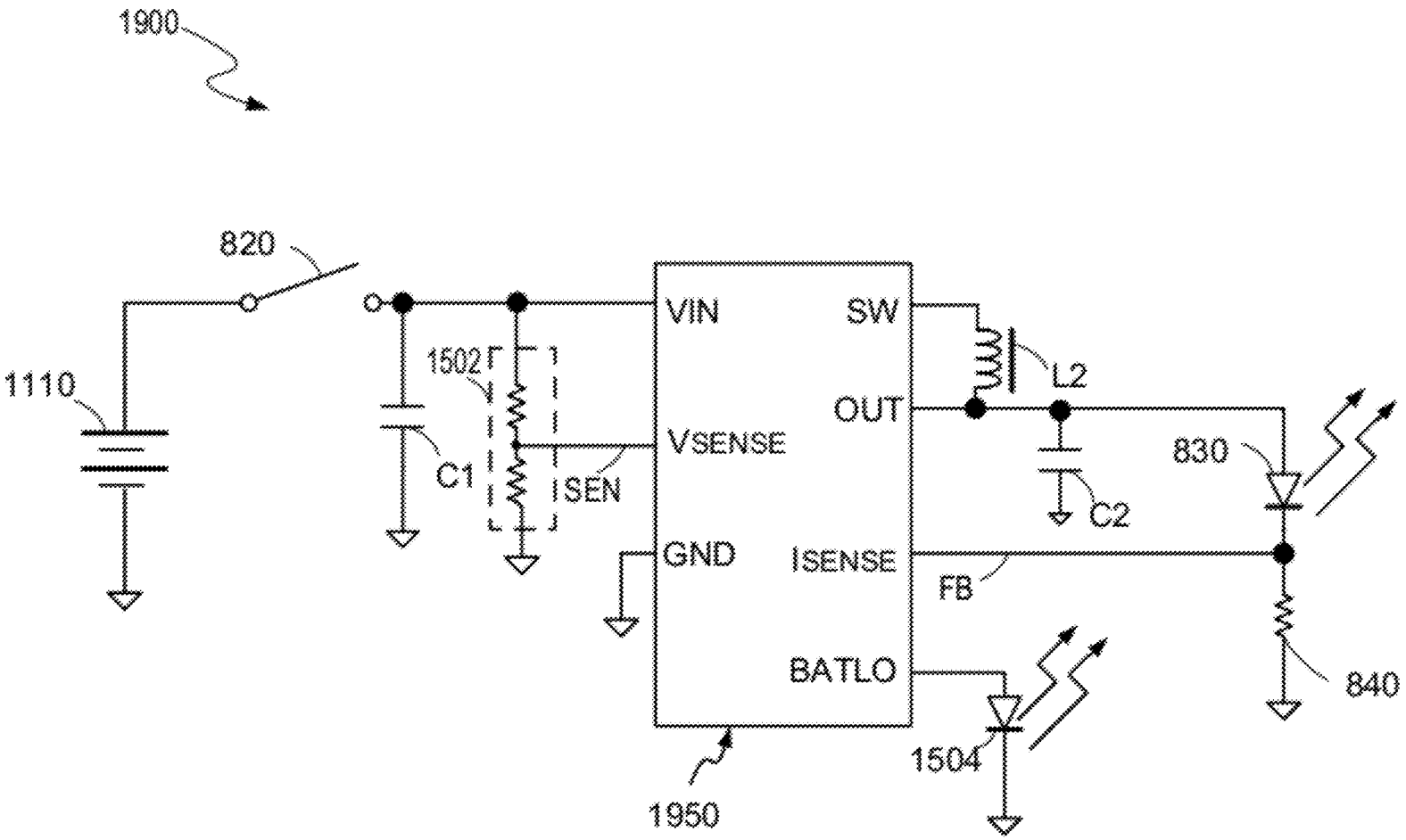
FIG. 19 shows a driving circuit in a portable lighting device, in accordance with one embodiment of the present invention.

FIG. 19 shows a driving circuit 1900, e.g., in a portable lighting device, in accordance with one embodiment of the present invention. The circuit 1300 includes a power source 1110, a switch 820, a light source 830, a sensor 840, a controller 1950, an inductor L2, a capacitor C1, and a capacitor C2. Elements labeled the same as in FIG. 12 and FIG. 15 have similar functions.

Figure 20:
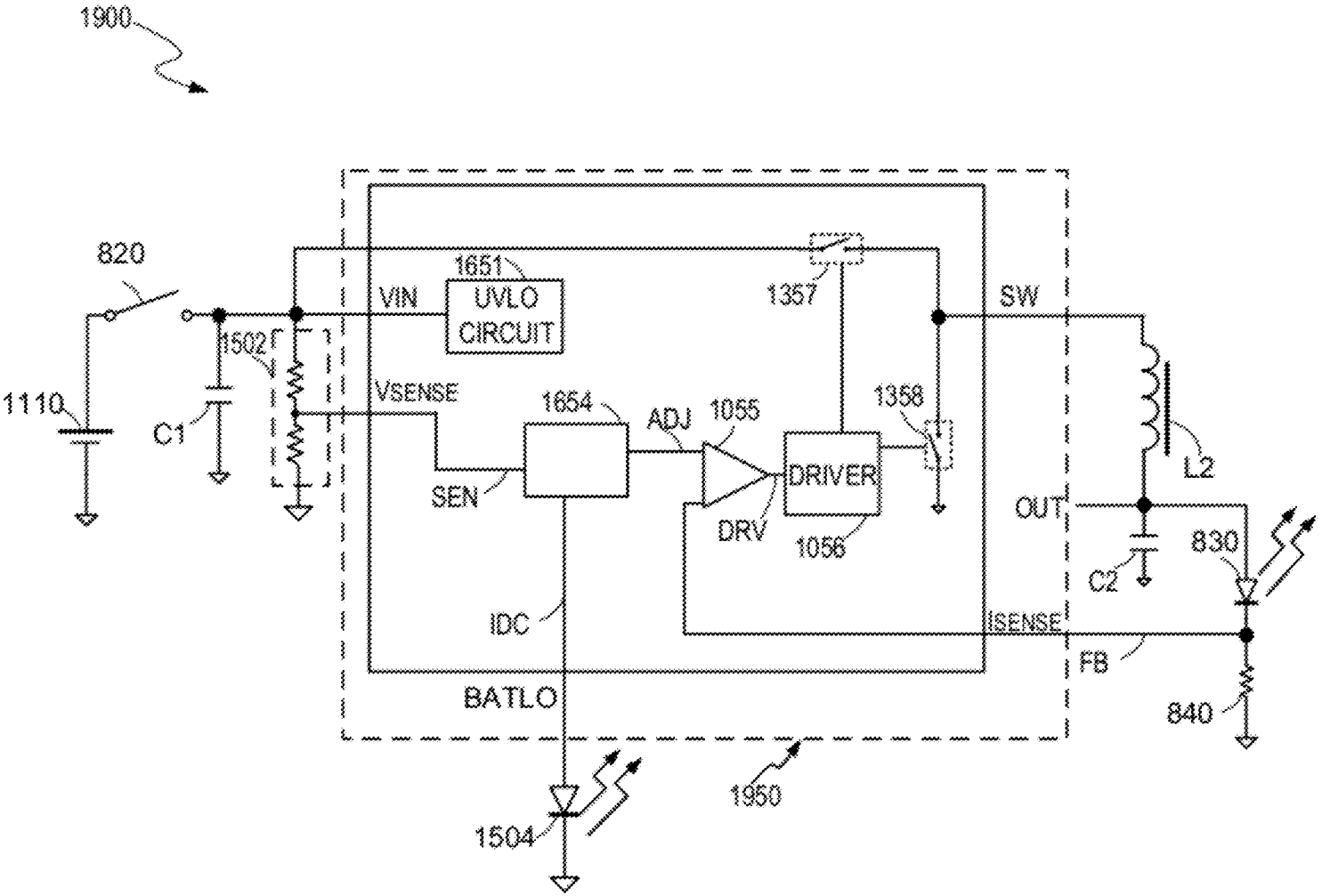
FIG. 20 shows a structure of the controller 1950 in FIG. 19, in accordance with one embodiment of the present invention.

FIG. 20 shows a structure of the controller 1950 in FIG. 13, in accordance with one embodiment of the present invention. Elements labeled the same as in FIG. 7 and FIG. 10 have similar functions. In one embodiment, the controller 1950 includes an under voltage lockout (UVLO) circuit 1651 coupled to the input terminal VIN, a reference signal generating unit 1654 coupled to the sensing terminal $V_{SENSE}$, a dimming unit 1055 coupled to the reference signal generating unit 1654, a driver 1056 coupled to the dimming unit 1055, a switch 1357 and a switch 1358 coupled to the driver 1056. In the example of FIG. 14, the switch 1357, the switch 1358, the capacitor C2 and the inductor L2 constitute a buck converter which can reduce the voltage at the power output terminal OUT of the controller 1950 to a lower voltage to drive the light source 830. In one embodiment, the switch 1357 and the switch 1358 can operate in a complimentary mode. In other words, the switch 1357 and the switch 1358 can be turned on and off alternately. In the example of FIG. 20, the output switching terminal SW is coupled to the power input terminal VIN through the switch 1357. The output switching terminal SW is coupled to ground through the switch 1358. The output switching terminal SW is also coupled to ground through the inductor L2 and the capacitor C2. Therefore, even if the voltage supplied by the power source 1110 is higher than a proper voltage (e.g., 6V) to drive the light source 830, the controller 1950 can drive the light source 830 with a reduced voltage provided by the buck converter.

Figure 21:
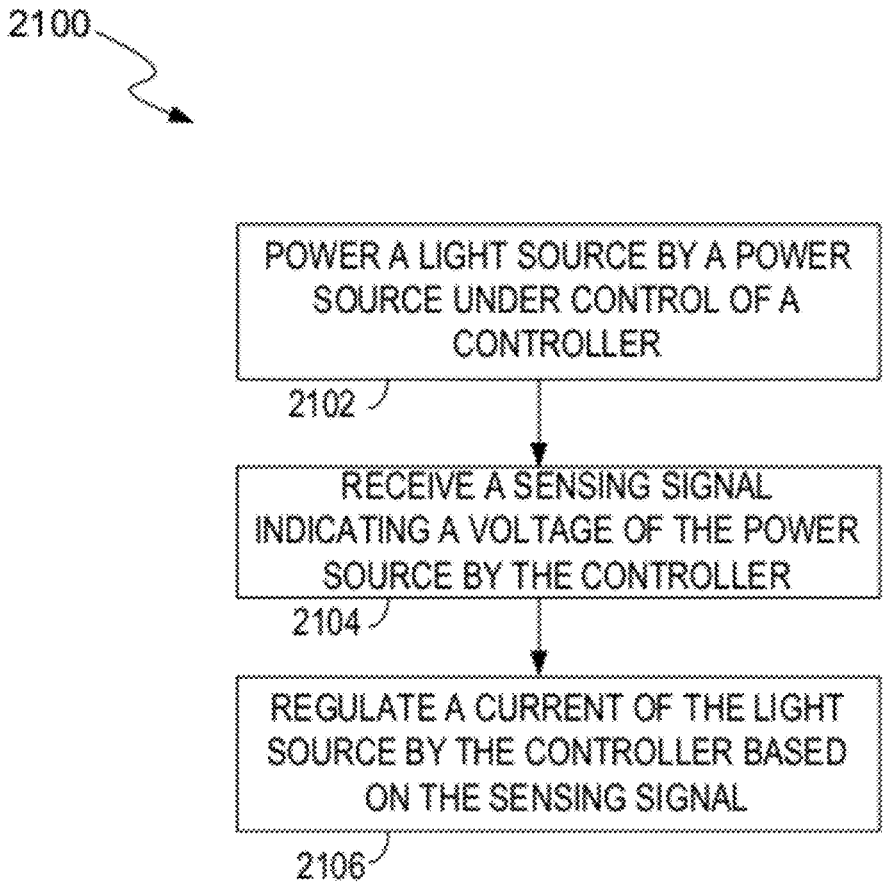
FIG. 21 shows a flowchart of a method for powering a light source, in accordance with one embodiment of the present invention.

FIG. 21 shows a flowchart 2100 of a method for powering a light source, in accordance with one embodiment of the present invention. In step 2102, a light source is powered by a power source under control of a controller. In step 2104, a sensing signal indicating a voltage of the power source is provided to the controller. In block 2106, a current of the light source is regulated by the controller based on the sensing signal. More specifically, the current of the light source is regulated to a first current level if the sensing signal indicates that the voltage of the power source is greater than a first voltage level. The current of the light source is regulated to a second current level if the sensing signal indicates that the voltage of the power source is less than a second voltage level. The second voltage level is less than the first voltage level. The current of the light source is regulated to vary according to a voltage of the sensing signal if the sensing signal indicates that the voltage of the power source is between the first voltage level and the second voltage level.

The method further includes generating a reference signal based on the sensing signal by the controller. The reference signal indicates a target current level of the light source. A voltage of the reference signal is at a first voltage level if the sensing signal indicates that the voltage of the power source is greater than the first voltage level. The voltage of the reference signal is at a second voltage level if the sensing signal indicates that the voltage of the power source is less than the second voltage level. The voltage of the reference signal varies linearly according to the voltage of the sensing signal if the sensing signal indicates that the voltage of the power source is between the first voltage level and the second voltage level.

The method further includes generating an indication signal based on the sensing signal by the controller to control an indicator. The indication signal is in a first state if the sensing signal indicates that the voltage of the power source is less than the second voltage level. The indication signal is in a second state if the sensing signal indicates that the voltage of the power source is greater than the second voltage level.

Advantageously, the present invention provides circuits for powering a light source. A controller senses a voltage of a power source, e.g., a battery, and adjusts a reference signal according to the voltage of the battery. The current of the light source is regulated according to the reference signal which indicates a target current level of the light source. If the voltage of the power source is relatively low, the current of the light source is regulated to a lower level. Therefore, the battery run time can be extended, thereby extending the operation time of the light source.

The term "battery" in the present invention is not limited to batteries consisting of dry cells or alkaline battery cells. The invention can use different types of batteries such as Lithium ion battery or other types of batteries. In the examples described above, an LED is used as a light source. However, any number of LEDs can be included. Furthermore, the light source is not limited to the LED. In the examples described above, the circuits are used in flash lights. However, the circuits can also be used in different types of lighting devices or systems with different sizes and purposes, e.g., head lamps or bicycle lamps.

While the foregoing description and drawings represent embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A portable lighting device comprising:

a power source that is operable for providing a voltage;

a load comprising a light emitting diode (LED) light source; and a controller that is operable for receiving said voltage and regulating a current of said LED light source based on a sensing signal indicating said voltage of said power source, wherein said controller is operable for regulating said current of said LED light source to a first current level if said sensing signal indicates that said voltage of said power source is greater than a first voltage level, wherein said controller is operable for regulating said current of said LED light source to a second current level if said sensing signal indicates that said voltage of said power source is less than a second voltage level, wherein said second voltage level is less than said first voltage level, and wherein said controller is operable for regulating said current of said LED light source to vary according to said sensing signal if said sensing signal indicates that said voltage of said power source is between said first voltage level and said second voltage level.

2. The portable lighting device of claim 1, wherein said controller is operable for regulating said current of said LED light source to vary linearly with said voltage of said power source based on said sensing signal and a feedback signal if said sensing signal indicates that said voltage of said power source is between said first voltage level and said second voltage level, wherein said feedback signal indicates an instant current of said LED light source.

3. The portable lighting device of claim 1, wherein said controller comprises a reference signal generating unit that is operable for generating a reference signal based on said sensing signal, wherein a voltage of said reference signal is at a first voltage level if said sensing signal indicates that said voltage of said power source is greater than said first voltage level, wherein said voltage of said reference signal is at a second voltage level if said sensing signal indicates that said voltage of said power source is less than said second voltage level, and wherein said voltage of said reference signal varies linearly according to a voltage of said sensing signal if said sensing signal indicates that said voltage of said power source is between said first voltage level and said second voltage level.

4. The portable lighting device of claim 3, wherein said reference signal generating unit comprises a first comparator that is operable for comparing said sensing signal with a first threshold, a second comparator that is operable for comparing said sensing signal with a second threshold signal, a sensing signal processing unit that a is operable for providing said processed signal based on said sensing signal, a first multiplexer that is operable for selectively outputting said processed signal or a first voltage signal according to an output of said first comparator, and a second multiplexer that is operable for selectively outputting an output of said first multiplexer or a second voltage signal according to an output of said second comparator to generates said reference signal.

5. The portable lighting device of claim 4, wherein said processed signal is proportional to said sensing signal.

6. The portable lighting device of claim 3, wherein said controller comprises a dimming unit that is operable for generating a dimming signal based on said reference signal and a feedback signal to regulate said current of said LED light source, wherein said feedback signal indicates an instant current of said LED light source.

7. The portable lighting device of claim 1, wherein said controller is operable for generating an indication signal based on said sensing signal, wherein said indication signal is in a first state if said sensing signal indicates that said voltage of said power source is less than said second voltage level, and wherein said indication signal is in a second state if said sensing signal indicates that said voltage of said power source is greater than said second voltage level.

8. The portable lighting device of claim 7, further comprising an indicator, wherein said indicator is turned on if said indication signal is in said first state, and wherein said indicator is turned off if said indication signal is in said second state.

9. The portable lighting device of claim 1, wherein said controller comprises a sensing terminal, coupled to said power source, that is operable for receiving said sensing signal indicating said voltage of said power source.

10. The portable lighting device of claim 1, wherein said controller comprises a power input terminal that is operable for receiving said voltage of said power source.

11. The portable lighting device of claim 10, wherein said controller comprises an output switching terminal coupled to said power input terminal through an inductor.

12. A method for powering a light emitting diode (LED) light source, comprising:

powering said LED light source by a power source under control of a controller;

receiving a sensing signal indicating a voltage of said power source by said controller;

regulating a current of said LED light source by said controller to a first current level if said sensing signal indicates that said voltage of said power source is greater than a first voltage level;

regulating said current of said LED light source by said controller to a second current level if said sensing signal indicates that said voltage of said power source is less than a second voltage level, wherein said second voltage level is less than said first voltage level; and regulating said current of said LED light source by said controller to vary according to a voltage of said sensing signal if said sensing signal indicates that said voltage of said power source is between said first voltage level and said second voltage level.

13. The method of claim 12, wherein said current of said LED light source is regulated to vary linearly with said voltage of said power source based on said sensing signal and a feedback signal if said sensing signal indicates that said voltage of said power source is between said first voltage level and said second voltage level, wherein said feedback signal indicates an instant current of said LED light source.

14. The method of claim 12, further comprising:

generating a reference signal based on said sensing signal by said controller;

controlling a voltage of said reference signal at a first voltage level if said sensing signal indicates that said voltage of said power source is greater than said first voltage level;

controlling said voltage of said reference signal at a second voltage level if said sensing signal indicates that said voltage of said power source is less than said second voltage level; and controlling said voltage of said reference signal to vary linearly according to said voltage of said sensing signal if said sensing signal indicates that said voltage of said power source is between said first voltage level and said second voltage level.

15. The method of claim 13, further comprising:

generating an indication signal based on said sensing signal by said controller to control an indicator, controlling said indication signal in a first state if said sensing signal indicates that said voltage of said power source is less than said second voltage level; and controlling said indication signal in a second state if said sensing signal indicates that said voltage of said power source is greater than said second voltage level.

16. A controller for controlling power of a light emitting diode (LED) light source, comprising:

a power input terminal, coupled to a power source, that is operable for receiving a voltage from said power source;

a sensing terminal, coupled to said power source, that is operable for receiving a sensing signal indicating said voltage of said power source; and a feedback terminal that is operable for receiving a feedback signal indicating an instant current of said LED light source, wherein said controller is operable for generating a reference signal indicating a target current of said LED light source based on said sensing signal and regulates a current of said LED light source based on said feedback signal and said reference signal, wherein a voltage of said reference signal is at a first voltage level if said sensing signal indicates that said voltage of said power source is greater than said first voltage level, wherein said voltage of said reference signal is at a second voltage level if said sensing signal indicates that said voltage of said power source is less than said second voltage level, and wherein said voltage of said reference signal varies linearly according to said voltage of said sensing signal if said sensing signal indicates that said voltage of said power source is between said first voltage level and said second voltage level.

17. The controller of claim 16, further comprising:

a first comparator that is operable for comparing a first threshold signal with said sensing signal;

a second comparator that is operable for comparing said sensing signal with a second threshold signal;

a sensing signal processing unit that is operable for providing a processed signal based on said sensing signal;

a first multiplexer that is operable for selectively outputting said processed signal or a first voltage signal according to an output of said first comparator; and a second multiplexer that is operable for selectively outputting an output of said first multiplexer or a second voltage signal according to an output of said second comparator to generates said reference signal.

18. The controller of claim 17, wherein said processed signal is proportional to said sensing signal.

19. The controller of claim 16, wherein said controller is operable for generating an indication signal based on said sensing signal, wherein said indication signal is in a first state if said sensing signal indicates that said voltage of said power source is less than said second voltage level, and wherein said indication signal is in a second state if said sensing signal indicates that said voltage of said power source is greater than said second voltage level.

20. The controller of claim 16, further comprising:

an indication terminal coupled to an indicator, wherein said indicator is turned on if said sensing signal indicates that said voltage of said power source is less than said second voltage level and is turned off if said sensing signal indicates that said voltage of said power source is greater than said second voltage level.

* * * * *